US010665100B2

(12) United States Patent
Munireddy et al.

(10) Patent No.: US 10,665,100 B2
(45) Date of Patent: May 26, 2020

(54) SYSTEMS AND METHODS FOR MANAGING AND TRACKING SPACE AVAILABILITY

(71) Applicant: Verizon Patent and Licensing Inc., Arlington, VA (US)

(72) Inventors: Umesh Saraki Munireddy, Frisco, TX (US); Anil Kumar, Basking Ridge, NJ (US); Alin D'Silva, Basking Ridge, NJ (US); Alan T. Hopper, Tampa, FL (US); Gunjan Desai, Morris Plains, NJ (US); Radoslaw Wilk, Irving, TX (US); John R. Canada, Dallas, TX (US); Heedoo Moon, Arlington, TX (US); Chethan Makam, Irving, TX (US)

(73) Assignee: Verizon Patent and Licensing Inc., Basking Ridge, NJ (US)

( * ) Notice: Subject to any disclaimer, the term of this patent is extended or adjusted under 35 U.S.C. 154(b) by 73 days.

(21) Appl. No.: 15/898,065

(22) Filed: Feb. 15, 2018

(65) Prior Publication Data

US 2019/0251841 A1 Aug. 15, 2019

(51) Int. Cl.
*G08G 1/14* (2006.01)

(52) U.S. Cl.
CPC ..... *G08G 1/142* (2013.01)

(58) Field of Classification Search
CPC ..... G08G 1/142; G08G 1/14; G08G 1/149; G08G 1/146; G06Q 30/0284
See application file for complete search history.

(56) References Cited

U.S. PATENT DOCUMENTS 8,504,864 B2 * 8/2013 Menon ..... B60T 7/18 370/350
9,031,089 B2 * 5/2015 Rubin ..... G08G 9/02 370/445
2006/0170566 A1 * 8/2006 Slemmer ..... G08G 1/14 340/932.2
2007/0050240 A1 * 3/2007 Belani ..... G06Q 30/0284 705/13
2013/0332060 A1 * 12/2013 Chowdhary ..... G06Q 10/087 701/300
2014/0249742 A1 9/2014 Krivacic et al.
(Continued)

FOREIGN PATENT DOCUMENTS

GB 2408132 A * 5/2005 ..... G08G 1/14

*Primary Examiner* — Adnan Aziz

(57) ABSTRACT

An exemplary parking facilitation system includes a plurality of parking space devices disposed at different parking spaces within a parking area and a parking management system configured to control operation of, and to exchange data with, the parking space devices. Each of the parking space devices respectively includes a processor, a vehicle presence detector configured to determine whether any vehicle is parked in a parking space at which the parking space device is disposed, and a parking availability indicator configured to visually indicate an availability status of the parking space. The parking availability indicator is positioned at a height greater than that of any vehicle that the parking space is configured to accommodate so as to be concurrently visible, with parking availability indicators of other parking space devices, from various locations within the parking area at which drivers attempting to locate available parking spaces are to be located.

20 Claims, 10 Drawing Sheets

(56) References Cited

U.S. PATENT DOCUMENTS

| | | | | |
|---|---|---|---|---|
| 2015/0138001 | A1* | 5/2015 | Davies | G08G 1/149 340/932.2 |
| 2015/0360720 | A1 | 12/2015 | Li et al. | |
| 2016/0133125 | A1* | 5/2016 | Sandbrook | G01V 3/12 340/933 |
| 2016/0178376 | A1 | 6/2016 | Moore | |
| 2019/0087877 | A1* | 3/2019 | Tashiro | G06Q 30/0284 |

* cited by examiner

SYSTEMS AND METHODS FOR MANAGING AND TRACKING SPACE AVAILABILITY

BACKGROUND INFORMATION

Scarcity of physical space has become a fact of life in our crowded modern society. As a result, it has become important to maximize usage of physical space resources in situations involving everything from airplane seating and cargo space to hospital bed availability. One area where a scarcity of physical space has become a challenge relates to parking. For example, for individuals who drive their own vehicles as transportation, finding available parking spaces may be a major inconvenience if their destinations lack ample parking. To make matters worse, if a destination is a workplace at which the individuals must recurrently park in order to go to work, this inconvenience may not only aggravate the individuals, but may also become a major source of lost productivity as workers spend time searching for available parking spaces rather than performing productive work.

At the same time, providing excess parking spaces may be a poor use of limited resources. Particularly in expensive geographical areas where real estate is at a premium, providing more parking spaces than is necessary may be equally or more wasteful, from a fiscal point of view, than the lost productivity and/or ill will that may result from forcing drivers to spend significant effort searching for parking spaces.

BRIEF DESCRIPTION OF THE DRAWINGS

The accompanying drawings illustrate various embodiments and are a part of the specification. The illustrated embodiments are merely examples and do not limit the scope of the disclosure. Throughout the drawings, identical or similar reference numbers designate identical or similar elements.

DETAILED DESCRIPTION OF PREFERRED EMBODIMENTS

Figure 1:
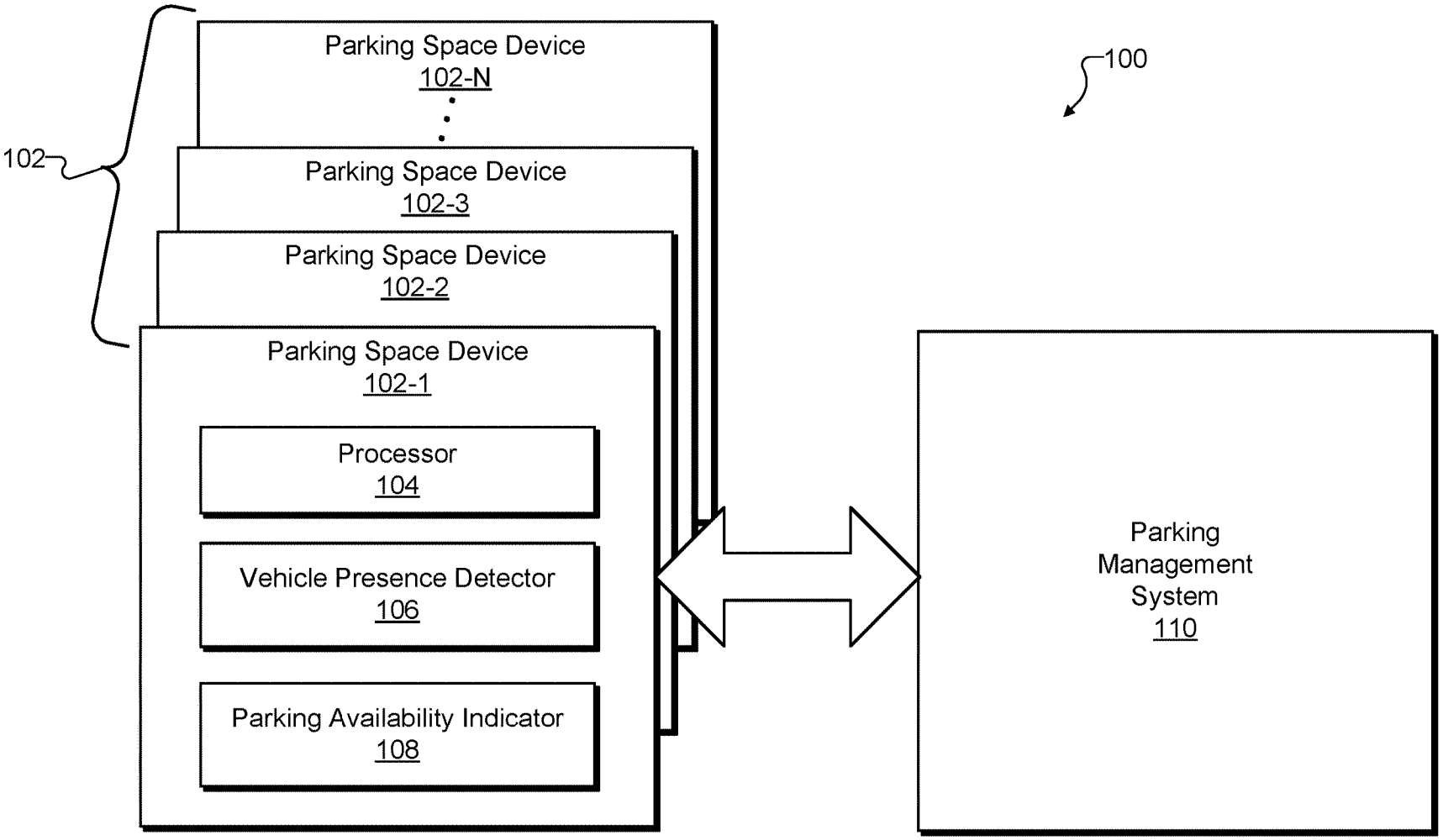
FIG. 1 illustrates an exemplary parking facilitation system for managing and tracking parking space availability according to principles described herein.

Systems and methods for managing and tracking space availability are described herein. For example, as will be described in more detail below, physical spaces may be managed and/or tracked by monitoring whether the spaces are available, indicating the availability of the spaces to various parties in a variety of ways, and/or otherwise managing and tracking the space availability in any manner as may serve a particular implementation. Examples illustrating systems and methods disclosed herein will focus on managing and tracking parking space availability. However, it will be understood that disclosed systems and methods for managing and tracking space availability may be applied to a variety of scenarios in which any type of physical space may be scarce and/or managed such that people wanting to use the resource associated with the physical space would benefit from the disclosed systems and methods. For example, along with physical spaces associated with parking (i.e., parking spaces), systems and methods disclosed herein may be similarly applied to other resource allocation situations involving spaces associated with seating assignments (e.g., airplane seating, train seating, bus seating, restaurant seating, auditorium or theater seating, etc.), workspaces (e.g., office spaces, cubicle spaces, desk spaces, computer availability, etc.), caretaking spaces (e.g., beds, rooms, or other resources at a hospital, assisted living center, or the like), living spaces (e.g., hostel beds, hotel rooms, etc.), object stowing and/or storage (e.g., cargo stowing in an airplane, cargo tracking, storage unit assignments, etc.), and/or any other resources (e.g., physical spaces) that may be allocated or assigned in a particular implementation.

In an exemplary resource allocation scenario involving parking spaces specifically, a parking facilitation system may include a plurality of parking space devices disposed at a plurality of different parking spaces within a parking area, and a parking management system communicatively coupled to each parking space device in the plurality of parking space devices. The parking space devices and parking management system may interoperate with one another, as well as, in certain examples, with one or more parking facilitation devices to monitor and indicate parking space availability to facilitate the task of locating available parking spaces for drivers.

To this end, each parking space device in the plurality of parking space devices included within the exemplary parking facilitation system may respectively include one or more components for monitoring, indicating, and/or otherwise managing and/or tracking parking space availability. For instance, each parking space device may respectively include a processor, a vehicle presence detector communicatively coupled to the processor, a parking availability indicator communicatively coupled to the processor, a communication interface by way of which the processor is communicatively coupled with the parking management system, and/or any other components as may serve a particular implementation.

When directed by the processor, the vehicle presence detector may determine whether any vehicle is parked in a parking space at which the parking space device is disposed. Similarly, when directed by the processor based on the determination (by the vehicle presence detector) of whether any vehicle is parked in the parking space, the parking availability indicator may visually indicate an availability status of the parking space.

In some examples, each parking space device (or, if the parking space devices are not implemented as integrated units, at least each parking availability indicator) may be positioned, with respect to a particular parking space with which it is associated, at a height greater than a height of any vehicle that the parking space is configured to accommodate. For example, if the parking space is included within a parking garage, the parking space device (or at least the parking availability indicator) may be attached above the parking space to a ceiling or structural element of the parking garage (e.g., attached directly to the ceiling or attached to a structure suspended from the ceiling). In other examples, the parking space device may be attached to a tall structure (e.g., a pole or wall that rises above the height of vehicles for which the parking space is configured) or otherwise suspended above the parking space. In this way, the parking availability indicator may be concurrently visible, with other parking availability indicators of other parking space devices in the plurality of parking space devices, from various locations within the parking area at which drivers attempting to locate available parking spaces are to be located. For example, a driver located at the end of a row of parking spaces may be able to look down the row and see parking availability indicators associated with each parking space on the row regardless of whether vehicles are or are not presently parked in the parking spaces.

As mentioned above, each of the parking space devices included in the parking facilitation system may be communicatively coupled to a parking management system that is also included in the parking facilitation system. The parking management system may be configured to control operation of the plurality of parking space devices. Additionally, the parking management system may exchange, with the plurality of parking space devices, data representative of the availability statuses of the different parking spaces at which the plurality of parking space devices is disposed.

Parking facilitation systems and methods described herein may provide various benefits to drivers attempting to locate available parking spaces, as well as to those who provide (e.g., design, pay for, administer, etc.) parking facilities for those drivers. For example, as drivers are searching for an available parking space, the drivers may be able to quickly and conveniently determine whether a particular parking area (e.g., a floor of a parking garage, a row of parking spaces, etc.) has any available parking spaces and where those parking spaces are located. Because parking availability indicators may be positioned in conspicuous locations at heights greater than the height of vehicles that might be parked in the parking area, drivers may see, at a glance, what the availability status is for each of the parking spaces in the parking area regardless of whether vehicles are parked in the some or all of the parking spaces.

This ability to determine the availability statuses of all the parking spaces at a glance may provide significant convenience to drivers compared to conventional approaches that drivers have used to determine parking space availability. For example, while it may be easy for a driver positioned directly in front of a particular parking space to see whether the parking space is currently occupied, it may be more difficult to determine, from a location at the end of a row of parking spaces, for example, whether any parking space in the row is available. As a result, drivers may drive through parking areas (e.g., rows of parking spaces, floors of parking garages, etc.) that appear to be full to double check that there is not an available parking space that could be used (e.g., a parking space whose availability is obscured from a viewpoint at the end of the row or from a particular place in the parking garage).

Additionally, even if a driver locates a parking space that is not occupied by a vehicle, using a conventional approach, it may be difficult for the driver to determine if the unoccupied parking space is actually an available parking space in which the driver is allowed to park. For example, the unoccupied parking space may be a reserved parking space (e.g., a handicap parking space, a special-use parking space permanently reserved for a certain person or category of people, a general-use parking space that has already been reserved by someone else using a parking pre-reservation system, etc.), a parking space designated for a different type of vehicle, a restricted parking space, or the like. Accordingly, by relying on the parking availability indicators provided by the parking facilitation systems described herein, drivers may not only find more unoccupied parking spaces more quickly and conveniently, but may also more easily and quickly identify which of those unoccupied parking space are available parking spaces that the drivers may use.

Along with these benefits provided at the parking area by way of conspicuously located parking availability indicators, drivers may also benefit from parking facilitation devices that are in communication with the parking facilitation system that is monitoring the parking space availability. For example, as will be described in more detail below, before even entering a parking facility, a driver may access information (e.g., from a mobile device application, from a display sign posted outside the parking area, etc.) indicative of whether parking spaces are available within the parking facility, where within the parking facility the available parking spaces are to be found, and so forth. In some examples, the parking facilitation system may even recommend a specific parking area and/or parking space to the driver by way of these parking facilitation devices and/or may allow the driver to reserve a specific parking space ahead of time.

In addition to benefiting drivers attempting to locate available parking spaces, parking facilitation systems and methods described herein may benefit administrators, companies, venues, and other entities that provide parking facilities. For example, by providing efficient and convenient ways for drivers to find available parking spaces, these entities may improve the morale of their respective patrons (e.g., employees, people attending an event, etc.) while freeing up the patrons to spend their time more productively. In the case of companies who provide parking facilities to employees, this may translate into significant increases in employee productivity without having to increase a number of parking spaces provided, which may not be possible (or may be prohibitively expensive) in certain geographies. Additionally, parking facilitation systems described herein may provide valuable information to parking facility providers regarding current parking space usage patterns. This information may enable the parking facility providers to make beneficial (e.g., cost effective) decisions in relation to how parking is to be administered.

Various embodiments will now be described in more detail with reference to the figures. The disclosed systems and methods may provide one or more of the benefits mentioned above and/or various additional and/or alternative benefits that will be made apparent herein.

FIG. 1 illustrates an exemplary parking facilitation system 100 ("system 100") for managing and tracking parking space availability. As shown, system 100 may include, without limitation, a plurality of parking space devices 102 (e.g., parking space devices 102-1 through 102-N) selectively and communicatively coupled to one another. In some examples, each parking space device 102 in the plurality of parking space devices 102 may include the same components and/or be configured to operate in the same way as (e.g., interchangeably with) each of the other parking space devices 102 in the plurality of parking space devices 102. Specifically, as explicitly shown for parking space device 102-1, each parking space device 102 may include a processor 104, a vehicle presence detector 106, and a parking availability indicator 108 selectively and communicatively coupled to one another within the parking space device. Additionally, each parking space device 102 may include a communication interface for communicating with other parking space devices 102 and/or with a parking management system 110.

It will be recognized that although distinct and separate components for processor 104, vehicle presence detector 106, and parking availability indicator 108 are shown in FIG. 1, these components may be representative of any suitable components (e.g., including more or fewer components than those explicitly shown) that operate to perform the functionality described below. Additionally, one or more of processor 104, vehicle presence detector 106, and parking availability indicator 108 may be omitted from parking space devices 102 in certain implementations, while additional components may be included within parking space devices 102 in the same or other implementations.

In some examples, each parking space device 102 may be implemented as an integrated unit. That is, processor 104, vehicle presence detector 106, parking availability indicator 108, and/or any other components of the parking space device 102 (e.g., including components making up a communication interface and the like) may be implemented within a single enclosure. For example, as will be described in more detail below, each parking space device unit in a plurality of parking space devices 102 may include a processor, a vehicle presence detector, a parking availability indicator, and other suitable components integrated into a single enclosure that is configured to be mounted above a particular parking space.

In other examples, the components of a particular parking space device 102 may be distributed (i.e., not all integrated into a single enclosure unit). For example, a vehicle presence detector of a particular parking space device 102 may be located on the ground (e.g., embedded in concrete of a parking space, attached to a curb adjacent to a parking space, etc.) while a parking availability indicator of the parking space device may be separate from the vehicle presence detector and mounted above the parking space device. The processor for this type of distributed parking space device may be in either of the locations of the vehicle presence detector and the parking availability indicator, distributed across both locations, or in yet another location.

Processor 104, vehicle presence detector 106, parking availability indicator 108, and the communication interface of a particular parking space device 102 (e.g., representative of any of parking space devices 102-1 through 102-N) will now be described in more detail.

Processor 104 may include any microprocessor or other type of processing unit, as well as any custom computer chip or other suitable implementation of computer logic. While not explicitly shown in FIG. 1, it will be understood that processor 104 may be communicatively coupled with memory devices and/or computer storage facilities that store software instructions to be performed by processor 104 to perform any suitable functionality. For example, processor 104 may receive instruction from parking management system 110 and, in accordance with that instruction, may direct other components of the parking space device 102 (e.g., including vehicle presence detector 106 and parking availability indicator 108) to perform certain operations as will be described below.

Vehicle presence detector 106 may be communicatively coupled to processor 104 and may be configured to determine (e.g., when directed by processor 104) whether any vehicle is parked in a parking space at which the parking space device is disposed. Vehicle presence detector 106 may include any type of sensing or detection technology and may operate in any manner as may serve a particular implementation. For example, in embodiments where the parking space device 102 is implemented as an integrated unit suspended above the parking space, vehicle presence detector 106 may include depth detection technology configured to determine, based on the depth of a surface detected to be immediately below where parking space device 102 is located, whether a vehicle is occupying the parking space. Such depth detection may be based on acoustic depth detection technologies such as ultrasound technology, on laser or other electromagnetic radiation depth detection technologies involving visible light or electromagnetic radiation at other suitable frequencies (e.g., infrared frequencies, microwave frequencies, etc.), or other suitable depth detection technologies. Similarly, vehicle presence detector 106 may be implemented as a camera or other imaging device configured to capture images (e.g., still photos, video images, etc.) that may be analyzed (e.g., by processor 104) to detect whether a vehicle occupies the parking space.

As another example (e.g., for embodiments where the parking space device 102 is in a distributed, rather than an integrated, configuration), vehicle presence detector 106 may operate using other suitable technologies besides depth detection technologies. For instance, vehicle presence detector 106 may include a magnetic sensor associated with the parking space or with a curb adjacent to the parking space, a sensor (e.g., an inductive loop sensor, a pressure sensor, etc.) built into the concrete of the parking space, or the like.

Parking availability indicator 108 may also be communicatively coupled to processor 104 and may be configured to visually indicate (e.g., when directed by processor 104) an availability status of the parking space. For example, the availability status may be determined (e.g., by processor 104) based on a determination by vehicle presence detector 106 whether any vehicle is parked in the parking space, as well as by other information (e.g., parking availability information that processor 104 receives from parking management system 110 related to a reservation status or other special status of the parking space).

Regardless of whether the parking space device 102 is implemented in an integrated configuration within a single consolidated enclosure, or in a distributed configuration, parking availability indicator 108 may be positioned at a height greater than a height of any vehicle that the parking space is configured to accommodate. In this way, parking availability indicator 108 may be concurrently visible, with other parking availability indicators of other parking space devices 102 in the plurality of parking space devices 102, from various locations within the parking area at which drivers attempting to locate available parking spaces are to be located. For example, parking availability indicator 108 may be conspicuously located so as to be visible, regardless of whether a vehicle is occupying the parking space, from various locations within the parking area including, for example, at the end of a row of parking spaces, at one end of a particular level of a parking garage, and so forth. As such, drivers attempting to locate available parking spaces may easily see whether the parking space is available, along with the other parking spaces around the parking space, at a glance without having to slowly drive around each level of the parking garage and/or down each row of parking spaces.

Along with processor 104, vehicle presence detector 106, and parking availability indicator 108, the parking space device 102 may further include other components not explicitly illustrated in FIG. 1. For example, as mentioned above, the parking space device 102 may include a communication interface by way of which processor 104 is communicatively coupled with parking management system 110. Additionally, the parking space device 102 may include memory, storage, power circuitry, and so forth. For example, the parking space device 102 may be hardwired to an electrical power source and/or may utilize batteries (e.g., including backup batteries for the event of a power failure), solar panels, and/or any other components for receiving, generating, and/or distributing electrical power as may serve a particular implementation.

As mentioned above, each of the parking space devices 102 in the plurality of parking space devices 102 may be communicatively coupled to a parking management system 110. Parking management system 110 may include any suitable computing technology (e.g., hardware, software, logic, communication interfaces, etc.) that is configured to control operation of parking space devices 102 and to exchange, with parking space devices 102, data representative of the availability statuses of the parking spaces at which parking space devices 102 are disposed. Parking management system 110 may perform any suitable operations to help system 100 operate in any of the ways described herein. Specific implementations and uses of parking management system 110 will be described in more detail below.

In operation, each parking space device 102 within system 100 may detect vehicle presence and indicate parking space availability in any manner as may serve a particular implementation. For example, a respective vehicle presence detector 106 in a particular parking space device 102 may be configured to determine whether any vehicle is parked in a parking space associated with the parking space device 102 by: 1) directing a pulse toward the parking space at a first time; 2) detecting a reflection of the pulse from a first reflection object at a second time subsequent to the first time; 3) determining, based on a known travel speed of the pulse and a difference between the first and second times, a first distance from the vehicle presence detector to the first reflection object; and 4) determining whether a vehicle is present based on a predetermined distance from the vehicle presence detector 106 to a second reflection object from which pulses reflect when no vehicle is parked in the parking space (e.g., the pavement of the parking space itself). For instance, the vehicle presence detector 106 may determine that no vehicle is parked in the parking space if the first distance is within a predetermined threshold of the predetermined distance (e.g., the distance to the pavement), and that a vehicle is parked in the parking space if the first distance is not within the predetermined threshold of the predetermined distance.

Figure 2C:
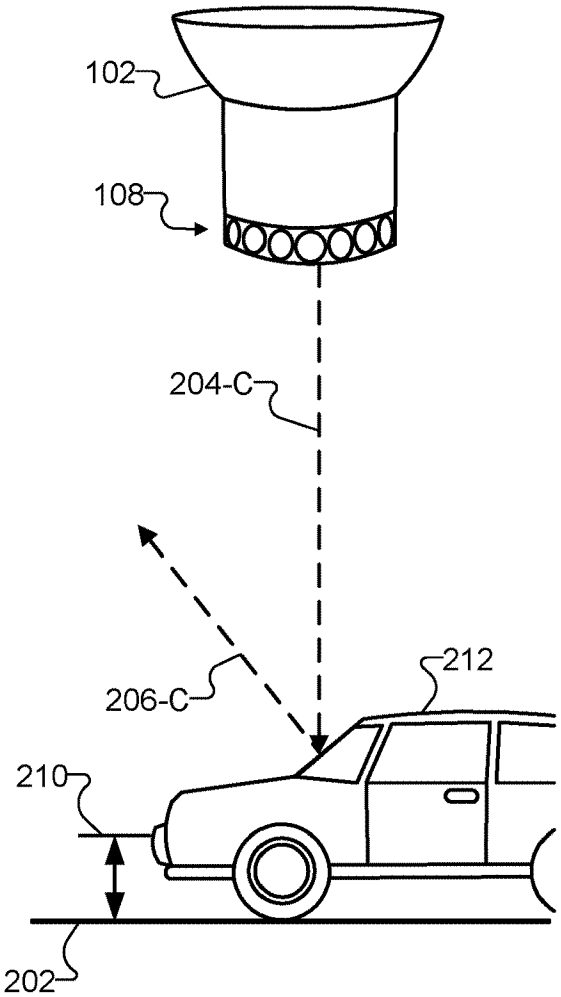
FIGS. 2A-2C illustrate an exemplary parking space device in operation as the parking space device determines whether any vehicle is parked in an exemplary parking space and visually indicates an availability status of the parking space according to principles described herein.
Figure 2B:
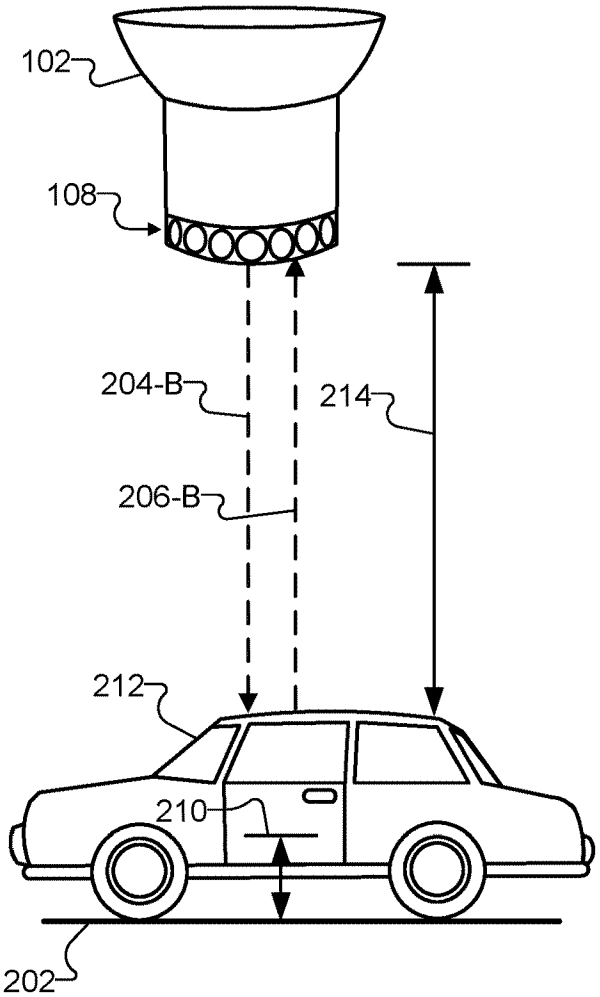
Figure 2A:
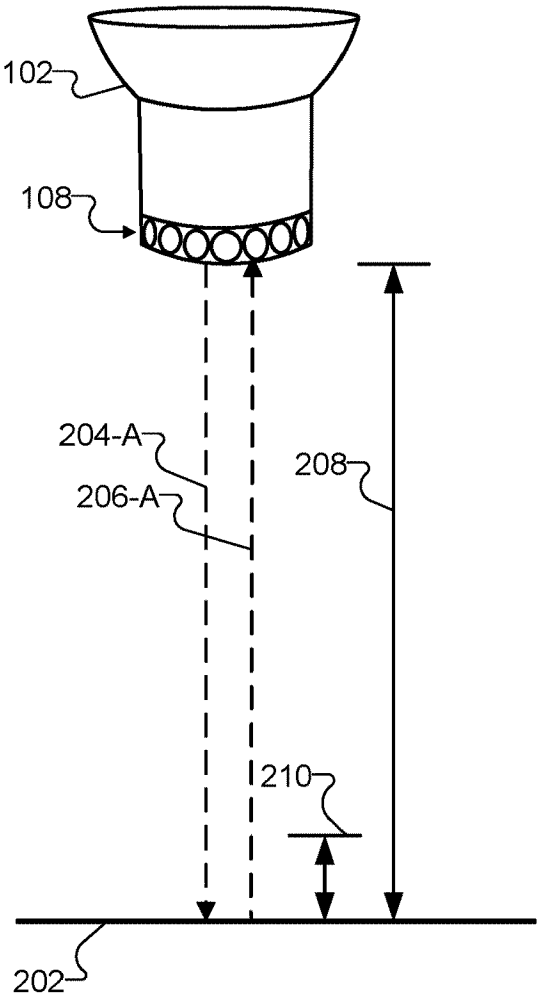

To illustrate, FIGS. 2A-2C depict an exemplary parking space device in operation as the parking space device determines whether any vehicle is parked in an exemplary parking space and visually indicates an availability status of the parking space. Specifically, as shown, FIGS. 2A-2C include an integrated implementation of a parking space device 102 such as those described above in relation to FIG. 1. As such, while not explicitly illustrated in FIGS. 2A-2C, it will be understood that a processor 104, a vehicle presence detector 106, and other suitable components are included within the enclosure of parking space device 102. Additionally, parking availability indicator 108 (e.g., including one or more light emitting diodes ("LEDs") or other visible indicators) is illustrated to be part of parking space device 102 within FIGS. 2A-2C.

As illustrated, parking space device 102 may be suspended above a parking space 202 to allow parking space device 102 to determine whether a vehicle is present in parking space 202, as well as to conspicuously indicate (e.g., so as to be visible from various locations around a parking area in which parking space 202 is included) an availability status of parking space 202. These operations may be performed in any suitable way.

For example, a predetermined distance from parking space device 102 (e.g., from the vehicle presence detector 106 within parking space device 102 in particular) to the pavement of parking space 202, which is known to be the reflection object from which pulses will reflect when no vehicle is parked in parking space 202, may be predetermined (e.g., as part of a calibration process that parking space device 102 is put through periodically and/or when the device is initially set up). Accordingly, FIG. 2A illustrates a scenario in which the vehicle presence detector 106 detects that there is no vehicle present, while FIGS. 2B and 2C illustrate different scenarios in which the vehicle presence detector 106 detects that there is a vehicle present.

As shown in FIG. 2A (in which no vehicle is present in parking space 202), parking space device 102 (e.g., the vehicle presence detector 106 of parking space device 102 in particular) may generate a pulse 204-A at a first time. Pulse 204-A may be a pulse of sound (e.g., ultrasound), light (e.g., infrared light, laser light, visible light, etc.), or any other pulse as may serve a particular implementation. Parking space device 102 may then, at a second time subsequent to the first time, detect a reflection 206-A of pulse 204-A (e.g., an echo, etc.) as pulse 204-A reflects from the pavement of parking space 202. The speed of travel of pulse 204-A in the medium of the air may be known. For example, if pulse 204-A is an ultrasound pulse, the speed of travel may be the speed of sound, while, if pulse 204-A is a pulse of light, the speed of travel may be the speed of light. Thus, based on the known travel speed and a difference between the first and second times (e.g., a "time of flight" of pulse 204-A to reach the pavement of parking space 202 and return back to parking space device 102 as reflection 206-A), parking space device 102 may determine that there is a distance 208 from parking space device 102 to the reflection object that reflected pulse 204-A (i.e., the pavement of parking space 202, in this example).

Based on the predetermined distance from parking space device 102 to the pavement (e.g., which may have been determined during a calibration procedure or the like, as described above), parking space device may now determine whether there is a vehicle present in parking space 202. Specifically, parking space device 102 may determine that no vehicle is parked in parking space 202 because distance 208 is within a predetermined threshold 210 of the predetermined distance. For example, predetermined threshold 210 may be large enough to account for a margin of error in the time of flight calculation and/or to account for minor changes to the height at which pulse 204-A will reflect (e.g., to account for a piece of litter or the like that could be left in parking space 202 and reflect pulse 204-A rather than the pavement to which the predetermined distance was specifically calibrated). At the same time, predetermined threshold 210 may be large enough that parking space 202 will not be detected to be unoccupied even if another object smaller than a typical vehicle but large enough to effectively occupy parking space 202 (e.g., such as a motorcycle, a shopping cart, etc.) is present.

In contrast, as shown in FIG. 2B (in which a vehicle is present in parking space 202), parking space device 102 may generate a pulse 204-B at a first time and detect a reflection 206-B at a second, subsequent time. However, in this case, because a vehicle 212 is now parked in parking space 202, parking space device 102 may determine (e.g., based on the time of flight difference between the first and second times, as described above) that there is only a distance 214 between parking space device 102 and the reflection object from which pulse 204-B reflected (i.e., vehicle 212, in this example). Thus, as in the previous example, parking space device 102 may determine, based on the difference between distance 214 and the predetermined distance to the pavement, that vehicle 212 is present. More specifically, parking space device 102 may determine that vehicle 212 is parked in parking space 202 because distance 214 is not within predetermined threshold 210 of the predetermined distance.

While the examples in FIGS. 2A and 2B are described in terms of distances, it will be understood that, in certain examples, distances may not be explicitly calculated and, instead, the vehicle presence detection may be performed solely in terms of travel times. For example, distances 208 and 214, as well as distance threshold 210 may be treated as travel times at a known speed (e.g., the speed of sound, the speed of light, etc.). Specifically, parking space device 102 may determine whether vehicle 212 is parked in parking space 202 by determining, based on a predetermined travel time of a pulse from parking space device 102 to the pavement, that no vehicle is parked in parking space 202 if a measured travel time is within a predetermined time threshold of the predetermined travel time, and that a vehicle is parked in parking space 202 if the measured travel time is not within the predetermined time threshold of the predetermined travel time.

While FIGS. 2A and 2B illustrate basic scenarios where a vehicle is present (i.e., FIG. 2B) or is not (i.e., FIG. 2A), it will be understood that, due to various anomalies, there may also be additional scenarios that are different from both of the scenarios depicted in FIGS. 2A and 2B. For example, as illustrated in FIG. 2C, parking space device 102 may attempt to detect vehicle presence at the exact moment that vehicle 212 is pulling into parking space 202, or vehicle 212 may not pull all the way into parking space 202 to be squarely positioned under parking space device 102. In these types of scenarios, as illustrated by FIG. 2C, parking space device 102 may be direct a pulse 204-C toward parking space 202, but then may not receive back a reflection 206-C allowing parking space device 102 to determine a time of flight distance analogous to distances 208 and 214 in FIGS. 2A and 2B, respectively. For example, reflection 206-C may reflect from vehicle 212 at an undesirable angle as shown, may be mostly or completely absorbed by vehicle 212, or may otherwise be intercepted or rerouted such that reflection 206-C does not return to parking space device 102. In spite of this anomaly, parking space device 102 may still be able to determine whether any vehicle is parked in the parking space. For example, parking space device 102 may determine that no reflection of pulse 204-C has been detected for a predetermined period of time after pulse 204-C is directed toward the parking space (e.g., an amount of time longer than a known time of flight from parking space device 102 to the pavement of parking space 202). Based on the determination that no reflection of pulse 204-C has been detected for the predetermined period of time, parking space device 102 may then determine that a vehicle is parked in the parking space.

Along with illustrating how vehicle presence is detected by the vehicle presence detector 106 included within parking space device 102, FIGS. 2A through 2C also illustrate the operation of the parking availability indicator 108 of parking space device 102. For example, parking availability indicator 108 may include colors, lights (e.g., multi-color LEDs or the like), textual displays, and/or any other suitable types of indicators as may serve a particular implementation. These indicators may be used to conspicuously indicate the availability of parking space 202 based on whether vehicle 212 is present in parking space 202, as well as based on other factors (e.g., whether parking space 202 is a reserved or special parking space, etc.), as will be described in more detail below.

Parking availability indicator 108 may make this indication in any suitable way. For example, parking availability indicator 108 may shine a light if parking space 202 is available and abstain from shining the light if parking space 202 is unavailable (or vice versa). As another example, parking availability indicator 108 may use colors to indicate different availability statuses. For instance, parking availability indicator 108 may shine a green light in scenarios such as illustrated in FIG. 2A, where parking space 202 is available, while shining an orange or red light in scenarios such as illustrated in FIGS. 2B and 2C, where parking space 202 is unavailable. Other colors (e.g., blue, yellow, white, etc.) may also be used to indicate other availability statuses such as that parking space 202 is available only for certain people (e.g., handicapped persons, patrons of a particular establishment, employees of a certain business, etc.), that parking space 202 is available only for certain types of vehicles (e.g., compact vehicles, delivery vehicles, etc.), that parking space 202 is currently reserved or otherwise disabled or unavailable for use, or the like.

As described above, it may be desirable for parking availability indicator 108 to be located conspicuously so as to be visible to drivers located at various locations throughout a parking area, and not just from a location directly in front of parking space 202. For example, such conspicuousness in parking availability indicator placement may facilitate drivers in locating available parking by allowing them to quickly drive past unavailable parking areas based on the indications from the parking space devices rather than having to search the parking areas manually in hopes of locating an available parking space. To this end, parking availability indicator 108 may be conspicuously positioned in any suitable way. For example, parking availability indicator 108 may be positioned at a height greater than the height of any vehicle that parking space 202 is configured to accommodate by being attached above parking space 202 to a ceiling or structural element of a parking garage within which the parking space is contained. It will be understood that parking availability indicator 108 may be attached to the ceiling or structural element by being attached directly to these structures, by being suspended from these structures, or by being attached to or suspended from other constructions (e.g., cables, pipes, etc.) that are attached to or suspended from these structures in any way as may serve a particular implementation. Additionally, in other examples, parking availability indicator 108 may be implemented in parking areas that are not parking garages (e.g., street parking, outdoor parking lots, etc.). In these and/or other examples, parking availability indicator 108 may be attached to or suspended from a pole, a nearby building, or the like.

Figure 3:
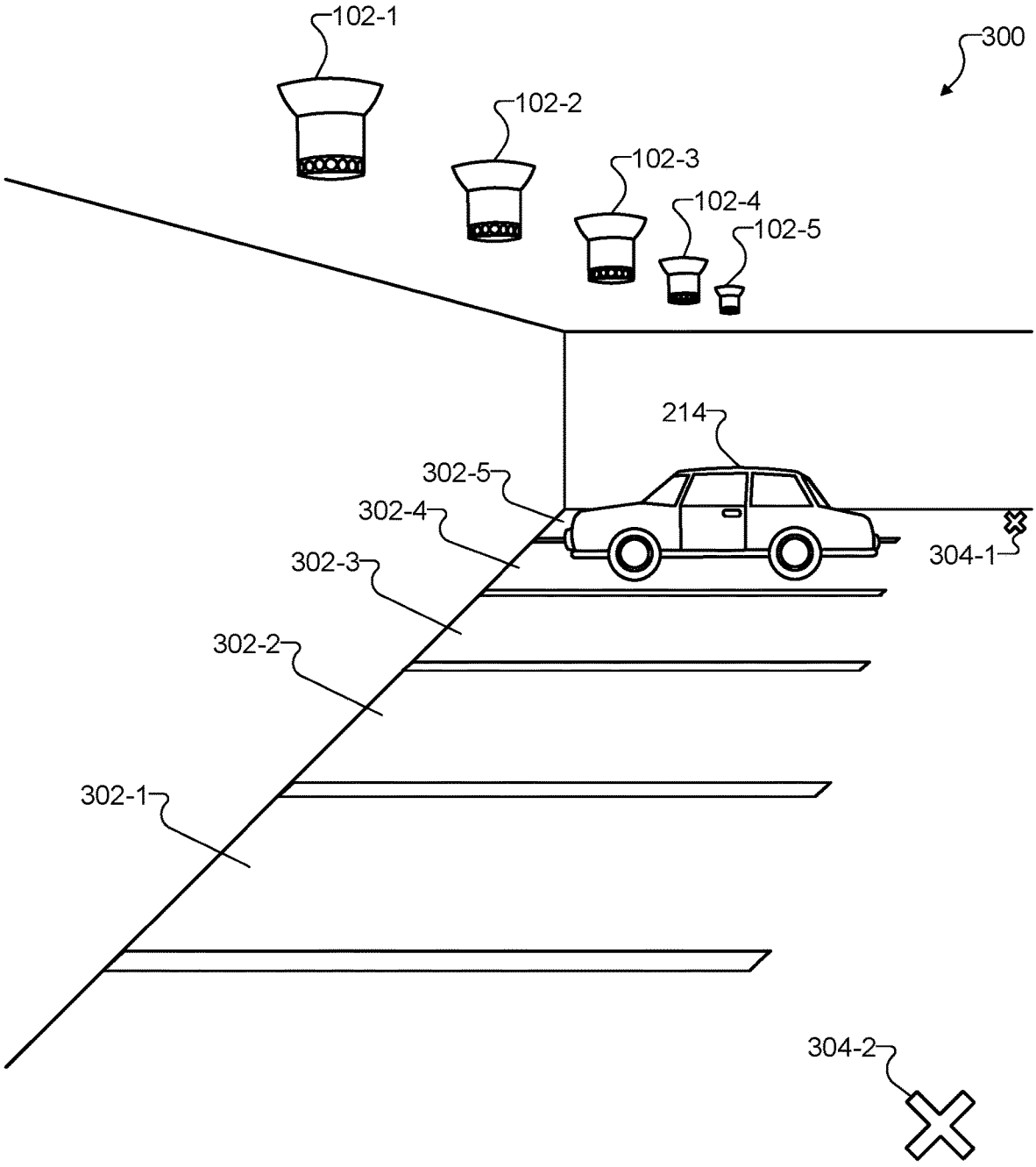
FIG. 3 illustrates a perspective view of a plurality of exemplary parking space devices disposed at a plurality of different parking spaces within an exemplary parking area according to principles described herein.

To illustrate one example of conspicuous placement of parking availability indicators included within respective parking space devices 102, FIG. 3 depicts a perspective view of a plurality of exemplary parking space devices disposed at a plurality of different parking spaces within an exemplary parking area. Specifically, as shown, a parking area 300 having a plurality of parking spaces 302 (e.g., parking spaces 302-1 through 302-5) includes, at conspicuous, easily-viewable locations above each parking space 302, a plurality of parking space devices 102 (e.g., parking space devices 102-1 through 102-5). As shown, even when a vehicle 214 is parked in one of parking spaces 302, such as parking space 302-4 in this example, each of the parking availability indicators continues to be visible from various locations within parking area 300. This may be convenient to a driver who cannot easily see, for example, whether a vehicle is located behind vehicle 214 in parking space 302-5, and who does not wish to drive down the row of parking spaces to check. For example, as shown, the parking availability indicator included within parking space device 102-5 above parking space 302-5 is not only easily viewable from a location 304-1 that is right in front of parking space 302-5, but is also easily viewable from a location 304-2 at the end of the row.

Accordingly, a driver attempting to locate a parking space may glance down a row and see, for example, a lineup of exclusively red-colored parking availability indicators. This driver may thus continue searching on the next row, confident that there is not an available parking space he or she is missing without having to have driven down the row. Conversely, in another example, the driver may glance down the row to find mostly red-colored parking availability indicators but also one green parking availability indicators at the end of the row (e.g., associated with a parking space such as parking space 302-5). In this case, the driver can take advantage of the available parking space even though he or she might not have otherwise taken time to drive down the row and discover it. Additionally, the parking availability indicators may provide a convenience of indicating not only whether parking spaces are unoccupied, but, more particularly, whether the parking spaces are actually available for use by particular drivers. For example, parking availability indicators indicating that certain parking spaces are for handicap use only may allow a driver who is not able to use handicap parking spaces to quickly pass by these parking spaces even if they are unoccupied and may otherwise appear to be available from the location of the driver.

As mentioned above, data representative of availability statuses (e.g., which may be at least partially based on determinations of whether parking spaces are unoccupied by vehicles) may be exchanged within system 100 between parking space devices 102 and parking management system 110. The data being exchanged may include data representative of special characteristics associated with particular parking spaces within the plurality of different parking spaces. For example, the special characteristics may be any of the characteristics described herein such as that a parking space is reserved, disabled, only for special use (e.g., compact car use, handicap use, etc.), or the like. The data representative of the special characteristics may be transmitted by parking management system 110 and received by the plurality of parking space devices 102. As such, the respective parking availability indicator included within each parking space device 102 may be configured to visually indicate the availability status of the respective parking space based on both the determination of whether any vehicle is parked in the parking space (i.e., as detected by the respective vehicle presence detector 106), and the data representative of the special characteristics (i.e., the data transmitted by parking management system 110).

While parking area 300 is only shown to include five parking spaces 302, it will be understood that systems and methods for managing and tracking parking space availability may be applied to many parking areas each including many parking spaces. For instance, in certain examples, systems and methods for managing and tracking parking space availability may be used to facilitate parking across garages and lots including hundreds or thousands of parking spaces distributed within many distinct parking areas.

Figure 4:
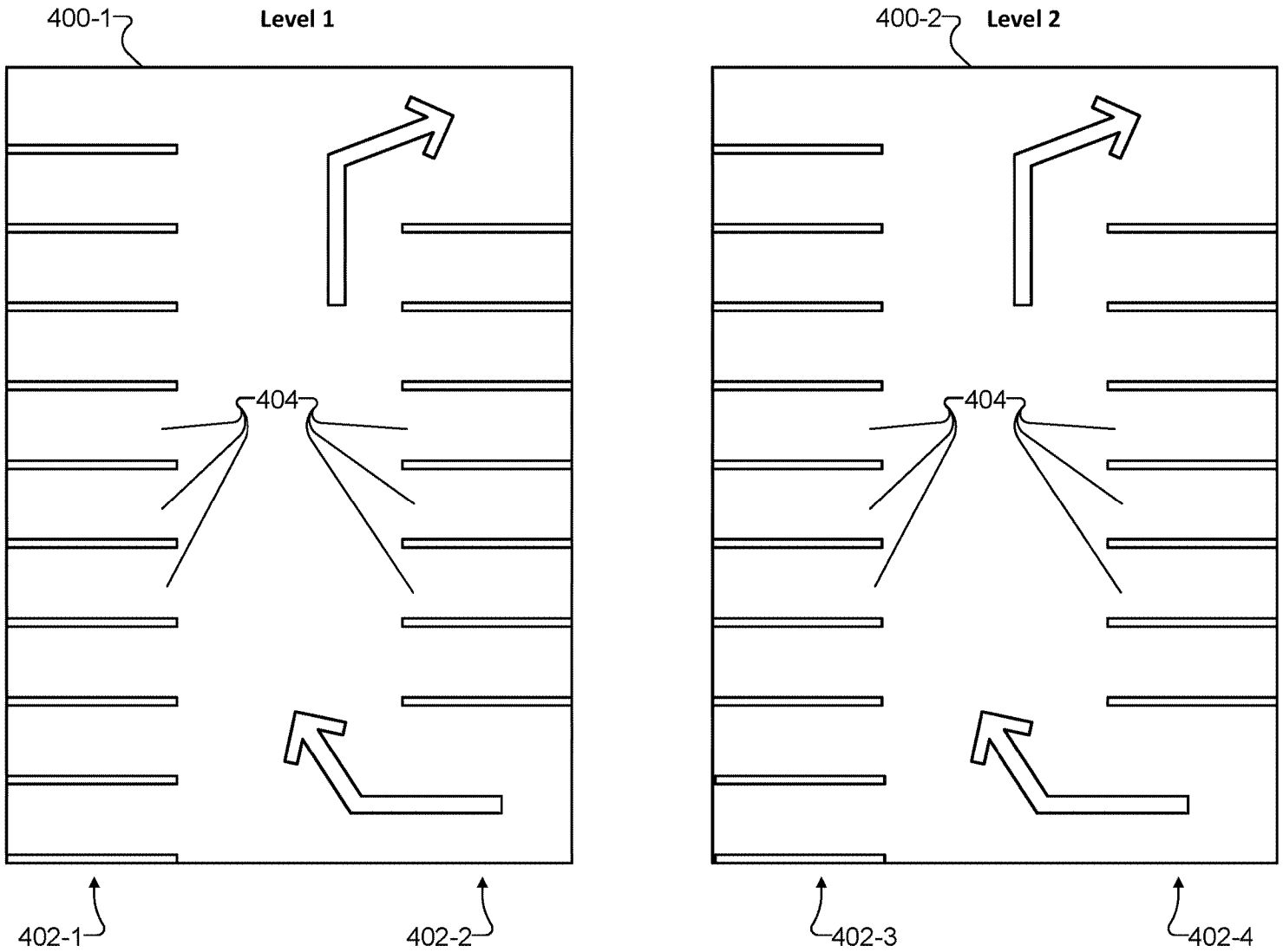
FIG. 4 illustrates a top view of different levels of an exemplary parking garage that includes a plurality of exemplary parking areas each having a plurality of different parking spaces according to principles described herein.

FIG. 4 illustrates a top view of different levels of an exemplary parking garage that includes a plurality of exemplary parking areas each having a plurality of different parking spaces. Specifically, the parking garage represented in FIG. 4 may include a plurality of levels 400 (e.g., a level 400-1 labeled "Level 1," a level 400-2 labeled "Level 2," etc.). Each level may include multiple rows 402 (e.g., rows 402-1 and 402-2 on level 400-1, rows 402-3 and 402-4 on level 400-2, etc.). As shown, each row 402 may include a plurality of parking spaces 404.

Each parking space 404 may include or be associated with exactly one parking space device 102 so that parking spaces 404 and parking space devices 102 have a one-to-one relationship. In other examples, one parking space device 102 may be configured to cover multiple parking spaces 404 (e.g., multiple adjacent parking spaces). In still other examples, multiple parking space devices 102 may be used to cover each parking space 404. For instance, by associating more than one parking space device 102 with a single parking space 404, the availability status of the parking space 404 may be determined with more accuracy. Specifically, if one parking space device 102 is located above the center of a parking space 404 while other parking space devices 102 are located at the sides of the parking space, system 100 may be able to not only detect when a vehicle is properly parked in the center of the parking space 404 (e.g., based on a detection by the center parking space device 102), but also when the vehicle is improperly parked across two or more parking spaces 404 (e.g., based on a detection by the parking space devices 102 on the sides of the parking space).

As used herein, a "parking area" may refer to any area that includes a plurality of parking spaces that are each located such that parking availability indicators associated with the parking spaces may be visible from various locations within and around the area. For example, in different examples, each row 402 in FIG. 4 could be said to constitute a different parking area, each floor 400 of the parking garage (e.g., each set of rows 402) could be said to constitute a different parking area, or the like. In other examples, parking areas may include a section of an outdoor parking lot, one or more consecutive city blocks along a road having street-side parking, or any other area of parking spaces as may serve a particular implementation.

Whether or not parking spaces are located in the same parking area in terms of parking availability indicator visibility, interference between different parking space devices 102 that are near one another may arise in certain implementations. For example, if vehicle presence detectors are employed that operate based on transmitting pulses and receiving reflections (e.g., sound-based pulses and reflections such as are transmitted and received by ultrasound-based depth detection technology), interference in which one vehicle presence detector receives a reflection from a pulse transmitted by a different vehicle presence detector at an unknown time may produce unpredictable and erroneous results.

Figure 5:
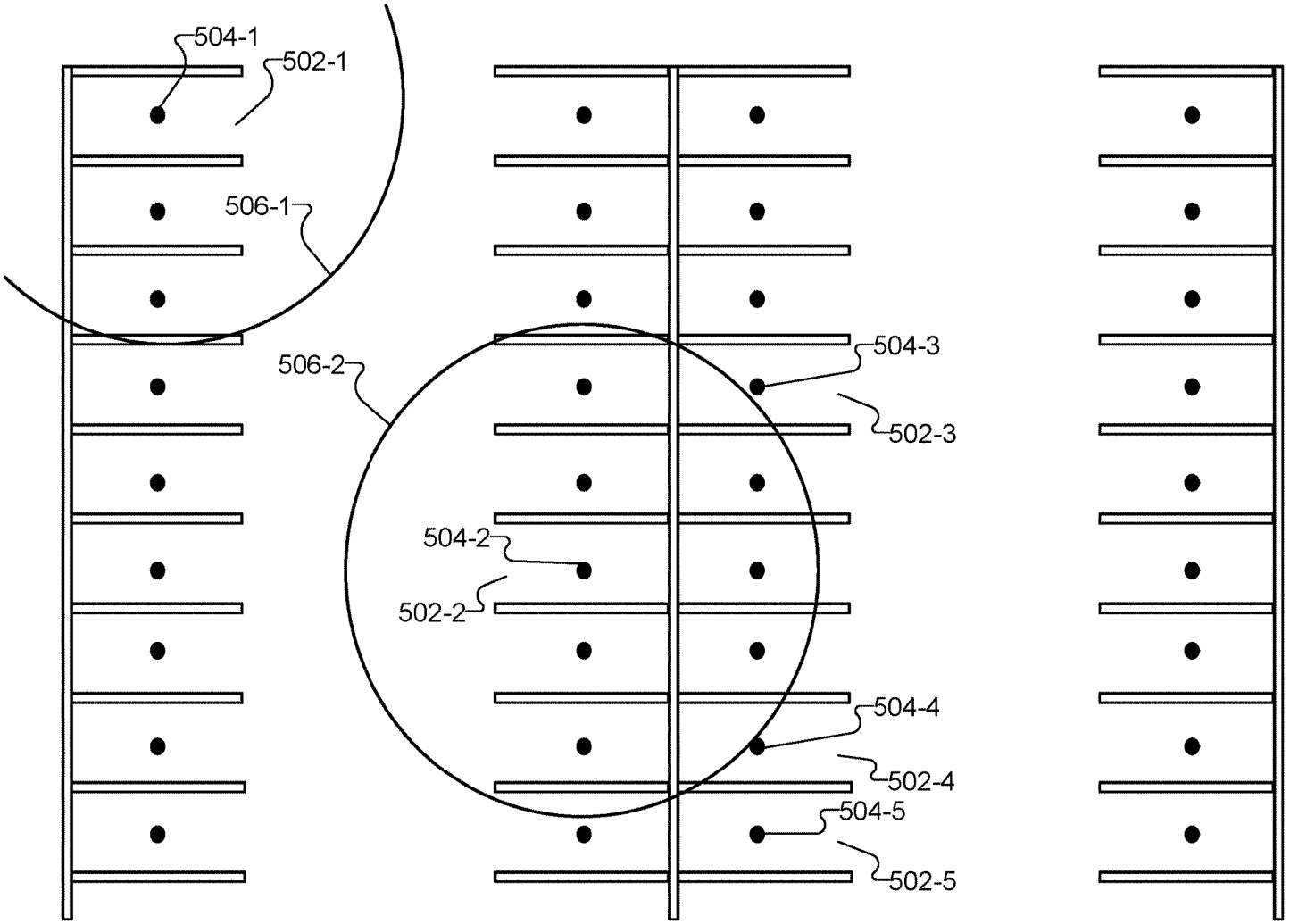
FIG. 5 illustrates a top view of an exemplary parking area in which parking space devices are disposed so as to potentially interfere with one another according to principles described herein.

For example, FIG. 5 illustrates a top view of an exemplary parking area in which parking space devices are disposed so as to potentially interfere with one another when detecting vehicle presence based on transmitting pulses and receiving reflections (e.g., sound pulses and echoes from the sound pulses). As shown, a parking area 500 includes a plurality of parking spaces 502 (e.g., parking spaces 502-1 through 502-5 and other illustrated parking spaces not explicitly labeled). Above the center of each parking space 502, a respective parking space device 504 (e.g., parking space devices 504-1 through 504-5 and other illustrated parking space devices not explicitly labeled) is located to detect vehicle presence in the respective parking space 502 and to indicate parking space availability such as in the ways described above. For example, each parking space device 504 may be an implementation of parking space device 102 with the same or similar features of various parking space devices 102 described above.

In FIG. 5, potential interference areas 506 (e.g., potential interference areas 506-1 and 506-2) are shown for two particular parking space devices 504. Specifically, a potential interference area 506-1 (i.e., the area within the portion of the partial circle illustrated in the corner of parking area 500) is depicted around parking space device 504-1, while a separate potential interference area 506-2 is depicted around parking space device 504-2. While only two potential interference areas 506 are illustrated in FIG. 5, it will be understood that similar potential interference areas may be similarly drawn around each parking space device 504 shown in parking area 500. As such, while the potential interference area of each parking space device 504 is different from all the others, each potential interference area may overlap substantially with respective potential interference areas of neighboring parking space devices 504.

Within a particular potential interface area 506, parking space devices 504 may be near enough to one another to interfere with one another. For example, all of the parking space devices 504 included within potential interference area 506-2 may be near enough to parking space device 504-2 to potentially interfere when parking space device 504-2 attempts to detect whether a vehicle is present in parking space 502-2. In an example employing ultrasound technology to perform vehicle presence detection, for instance, parking space device 504-2 may be near enough to each of the parking space devices 504 included within potential interference area 506-2 to detect (e.g., receive, "hear," etc.) ultrasound pulses transmitted by these parking space devices 504 (i.e., transmitted for the purpose of detecting vehicles within their own respective parking spaces 502). Additionally, other parking space devices 504 such as parking space devices 504-3 and 504-4 that are technically outside the radius of potential interference area 506-2 but are very near to it, may also pose a potential interference risk and may thus be treated the same as if they were included within potential interference area 506-2. Conversely, various other parking space devices 504 such as parking space device 504-5 may be far enough outside of potential interference area 506-2 so as not to pose a potential interference risk with parking space device 504-2.

A parking facilitation system such as system 100 may avoid potential or detected interference issues problems in any manner as may serve a particular implementation. For example, parking space devices 504 may all be included within a parking facilitation system along with a parking management system (e.g., such as parking management system 110 described above) communicatively coupled with, and configured to manage, all of parking space devices 504. The parking management system may control the operation of each respective parking space device so as to avoid interference. To use parking space device 504-2 as an example, the parking management system may control the operation of parking space device 504-2 by synchronizing a local time maintained by parking space device 504-2 with a master time maintained by the parking management system. The parking management system may also identify an additional parking space device in the plurality of parking space devices that is within a radius of potential interference from the parking space device (e.g., within potential interference area 506-2 or very near to it). For example, the parking management system may identify that parking space device 504-3 is within the radius of potential interference. As a result, the parking management system may direct parking space device 504-2 to perform the determination of whether any vehicle is parked in parking space 502-2 during a first time slot within a plurality of time slots associated with the master time, while directing parking space device 504-3 to perform a determination of whether any vehicle is parked in parking space 502-3 during a second time slot within the plurality of time slots. Specifically, the second time slot may be distinct from, and not overlapping with, the first time slot such that the risk of interference between parking space devices 504-2 and 504-3 is reduced or eliminated due to a separation in time when they each operate.

Additional time slots within the plurality of time slots may thus be assigned to each of the other parking space devices 504 included within potential interference area 506-2, as well as to parking space devices 504 that are very close to potential interference area (e.g., parking space device 504-4), to likewise ensure that these parking space devices 504 do not interfere with vehicle presence detection performed by parking space device 504-2. However, for parking space devices 504 that do not pose an interference risk with parking space device 504-2 (e.g., such as parking space devices 504-1, 504-5, and other parking space devices far outside the radius of potential interference represented by potential interference area 506-2), a time slot may be assigned that is not distinct from and/or that does overlap with the first time slot assigned to parking space device 504-2.

More specifically, the parking management system may further control the operation of parking space device 504-2 by identifying an additional parking space device that is outside the radius of potential interference from parking space device 504-2 (e.g., parking space device 504-5). The parking management system may then direct the additional parking space device to perform a determination of whether any vehicle is parked in its respective parking space (e.g., parking space 502-5) during the first time slot.

Along with separating vehicle presence detection operations by time as described above (i.e., assigning different time slots to neighboring parking space devices 504 to avoid interference between them), other methods of separating vehicle presence detection operations or otherwise minimizing interference potential may also be employed as may serve a particular implementation. For example, instead of a time separation between parking space devices 504, a frequency separation may be employed where neighboring parking space devices 504 are each assigned unique frequencies at which to transmit and receive pulses.

In theory, most or all vehicle presence detection interference of the type described above may be eliminated by preplanning and selectively assigning different time slots or pulse frequencies to each parking space device 504 operating in a particular parking area. However, in practice, issues may arise that still cause parking space devices 504 to become unsynchronized and/or to otherwise unexpectedly interfere with one another. Additionally, it may be desirable for a parking facilitation system to eliminate interference without strategic preplanning on the part of operators administering the parking facilitation system.

As a result, artificial intelligence, machine learning, and other such techniques may be employed to detect, identify, and handle interference issues in an automated fashion that does not require human intervention. For example, a machine learning algorithm may identify an interference issue when an unexpected behavior or result is observed. Potential interference issues may be revealed, for instance, by an observation that a particular vehicle presence detector is toggling too often (i.e., indicating that a vehicle is repeatedly pulling in and pulling out of the associated parking space at a rate or for a duration of time that is unlikely to be occurring in actuality). As another example, potential interference issues may be revealed by an observation that the time of flight of transmitted pulses is too short or too long (i.e., indicating that a vehicle is of a size or shape that it is unlikely to be in actuality).

When such potential interference issues are identified, the parking facilitation system may reassign time slots or frequencies as appropriate to attempt to resolve the interference issues. Specifically, referring again to the example of parking space device 504-2, the parking management system within the parking facilitation system may control the operation of parking space device 504-2 by recognizing (e.g., based on a machine learning algorithm) an anomalous outcome of the determination of whether any vehicle is parked in parking space 502-2 (e.g., an anomalous outcome such as the potential interference issues described above). The parking management system may then direct parking space device 504-2 to perform subsequent determinations of whether any vehicle is parked in parking space 502-2 during a different time slot within the plurality of time slots. For example, a time slot distinct from, and not overlapping with, the first time slot or any other time slots currently assigned to parking space devices 504 within the radius of potential interference may be assigned. Additionally or alternatively, the parking management system may also swap assigned time slots, readjust all the time slots to be further apart or closer together, add new time slots to the plurality of time slots being used, or the like. For example, if ten time slots of one second each are being used (i.e., such that each of ten parking space devices repeatedly determines whether any vehicle is parked in its respective parking space during a one-second period every ten seconds) when the machine learning algorithm recognizes the anomalous outcome, an eleventh time slot may be added such that each of the ten parking space devices begins to perform the determination only once every eleven seconds.

As described and illustrated above in relation to FIG. 1, system 100 may include parking management system 110 communicatively coupled to and configured to control the plurality of parking space devices 102. FIGS. 2A through 5 have illustrated various aspects of the functionality, placement, and preferred usage of such parking space devices, and the description of these figures has mentioned how the parking space devices perform operations under direction of a parking management system such as parking management system 110 within a comprehensive parking facilitation system such as system 100. Additional details about parking management system functionality and communications between parking space devices and parking management systems will now be described.

Figure 6:
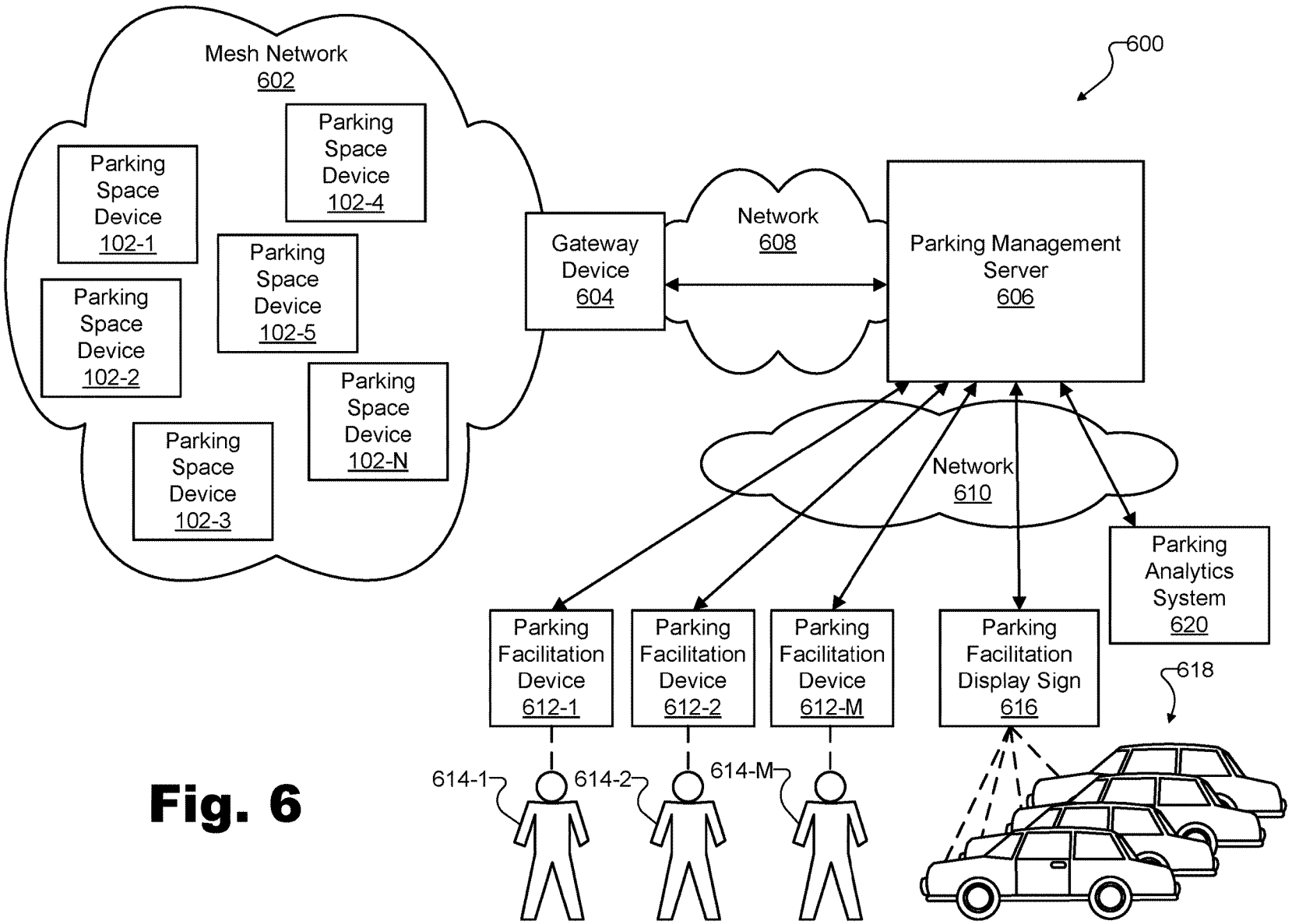
FIG. 6 illustrates an exemplary configuration in which the parking facilitation system of FIG. 1 interoperates with a plurality of exemplary parking facilitation devices to monitor and indicate parking space availability according to principles described herein.

FIG. 6 illustrates an exemplary configuration 600 in which system 100 interoperates with a plurality of exemplary parking facilitation devices to monitor and indicate parking space availability. Specifically, in configuration 600, system 100 is implemented by the plurality of parking space devices 102 being communicatively coupled to one another by way of a mesh network 602, and by a gateway device 604 and a parking management server 606 that are communicatively coupled to one another by way of a network 608 and that collectively implement parking management system 110 of system 100. The gateway device 604 is configured to facilitate communication between the plurality of parking space devices 602 and parking management server 608.

FIG. 6 also illustrates how system 100 (i.e., parking space devices 102, gateway device 604, and parking management server 606) communicates, by way of a network 610, with various parking facilitation devices. For example, as shown, parking management server 606 is communicatively coupled to a plurality of parking facilitation devices 612 (e.g., parking facilitation devices 612-1 through 612-M) each associated with a respective user 614 (e.g., users 614-1 through 614-M), a parking facilitation display sign 616 serving various vehicles 618, and a parking analytics system 620. Each of the elements in FIG. 6 will now be described.

Mesh network 602 may provide a communication infrastructure by way of which parking space devices 102 may communicate with one another and with gateway device 604. For example, parking space devices 102 may each include a communication interface based on wireless radio technology. However, every parking space device 102 may not have close proximity to gateway device 604, a line of sight with gateway device 604 by way of which radio signals may travel without interference, or the like. Accordingly, it may not be possible for each parking space device 102 to communicate with gateway device 604 directly, especially if there are hundreds of parking space devices 102 in a large, multi-level, concrete parking garage through which wireless signals cannot easily travel. Rather than direct communication, parking space devices 102 may thus communicate by passing messages from device to device (e.g., between devices that are near one another and/or have good line of sight or the like) in a mesh networking fashion.

Gateway 604 may be included within parking management system 110 along with parking management server 606, or, in other examples, may implement parking management system 110 alone or with other components. In some examples, multiple gateway devices 604 (e.g., each associated with a few hundred parking space devices 102, for instance) may be employed to communicate with one another and with parking management server 606 in an exemplary implementation of parking management system 110. Gateway device 604 may facilitate communications between parking space devices 102 and parking management server 606 by receiving, consolidating, and exchanging messages (e.g., including data representative of instructions, availability statuses of parking spaces, etc.) between the parking space devices 102 on mesh network 602 and parking management server 606 over network 608.

Parking management server 606 may similarly be included within or may implement parking management system 110, and may include processing, memory, and storage resources for performing any of the operations described herein. For example, parking management server 606 may include one or more computing devices (e.g., server computers, database storage centers, etc.) for controlling operation of the plurality of parking space devices 102 on mesh network 602 in any of the ways described herein and/or for exchanging data with the parking space devices 102. For example, the exchanged data may be representative of the availability statuses of the different parking spaces at which the plurality of parking space devices 602 is disposed. Parking management server 606 may be communicatively coupled with one or more gateway devices such as gateway device 604 to manage as many parking space devices 102 as may be employed in a particular implementation.

Network 608 may provide data delivery infrastructure between gateway device 604 and parking management server 606. As such, network 608 may include a provider-specific wired or wireless communication network (e.g., a cable or satellite carrier network or a mobile telephone network), the Internet, a wide area network, a content delivery network, and/or any other suitable network or networks, and data may be distributed using any suitable communication technologies included within network 608.

Similarly, network 610 may provide data delivery infrastructure between parking management server 606 and parking facilitation devices such as parking facilitation devices 612, parking facilitation display sign 616, and parking analytics system 620. Like network 608, network 610 may include any provider-specific wired or wireless communication network, the Internet, a wide area network, a content delivery network, and/or any other suitable network or networks, and data may be distributed using any suitable communication technologies included within network 608. In some examples, network 610 may be integrated with network 608, while, in other examples, networks 608 and 610 may be separate and distinct from one another. On either network 608 or 610, data may flow using any communication technologies, devices, media, and protocols as may serve a particular implementation.

Collectively implementing parking management system 110, either or both of gateway device 604 and/or parking management server 606 may operate to manage and control parking space devices 102 in any manner as may serve a particular implementation. For example, as described above, either of these components may store and transmit data representative of parking space availability such as relating to reserved or special parking spaces. As another example, when firmware updates are released for parking space devices 102, parking management server 606 and/or gateway device 604 may systematically load the new firmware onto parking space devices 102 (e.g., in the background as the parking space devices continue to operate), confirm (e.g., via comparing checksums, etc.) that each parking space device 102 has properly received and stored an uncorrupted image of the new firmware, and direct each parking space device 102 to restart using the newly loaded firmware.

In addition to interoperating with gateway device 604 to manage parking space devices 102, parking management server 606 may be further configured to provide data representative of the availability statuses of different parking spaces to one or more parking facilitation devices communicatively coupled to parking management server 606. These parking facilitation devices may be any suitable devices as may serve a particular implementation.

As one example, parking facilitation devices may be implemented by respective mobile devices (e.g., parking facilitation devices 612) associated with drivers attempting to locate the available parking spaces (e.g., users 614). For example, mobile devices may include smart phones, tablet computers, laptop computers, smart watches, car navigation systems, and/or other mobile devices that may be used by drivers or passengers within a vehicle trying a locate an available parking space.

Parking facilitation devices 612 may be configured to present (e.g., to respective users 614) data representative of the availability statuses of the different parking spaces at which parking space devices 102 are disposed. For example, parking facilitation devices 612 may receive the data representative of the availability statuses from parking management server 606 as described above and may present the data in any suitable way.

Figure 7:
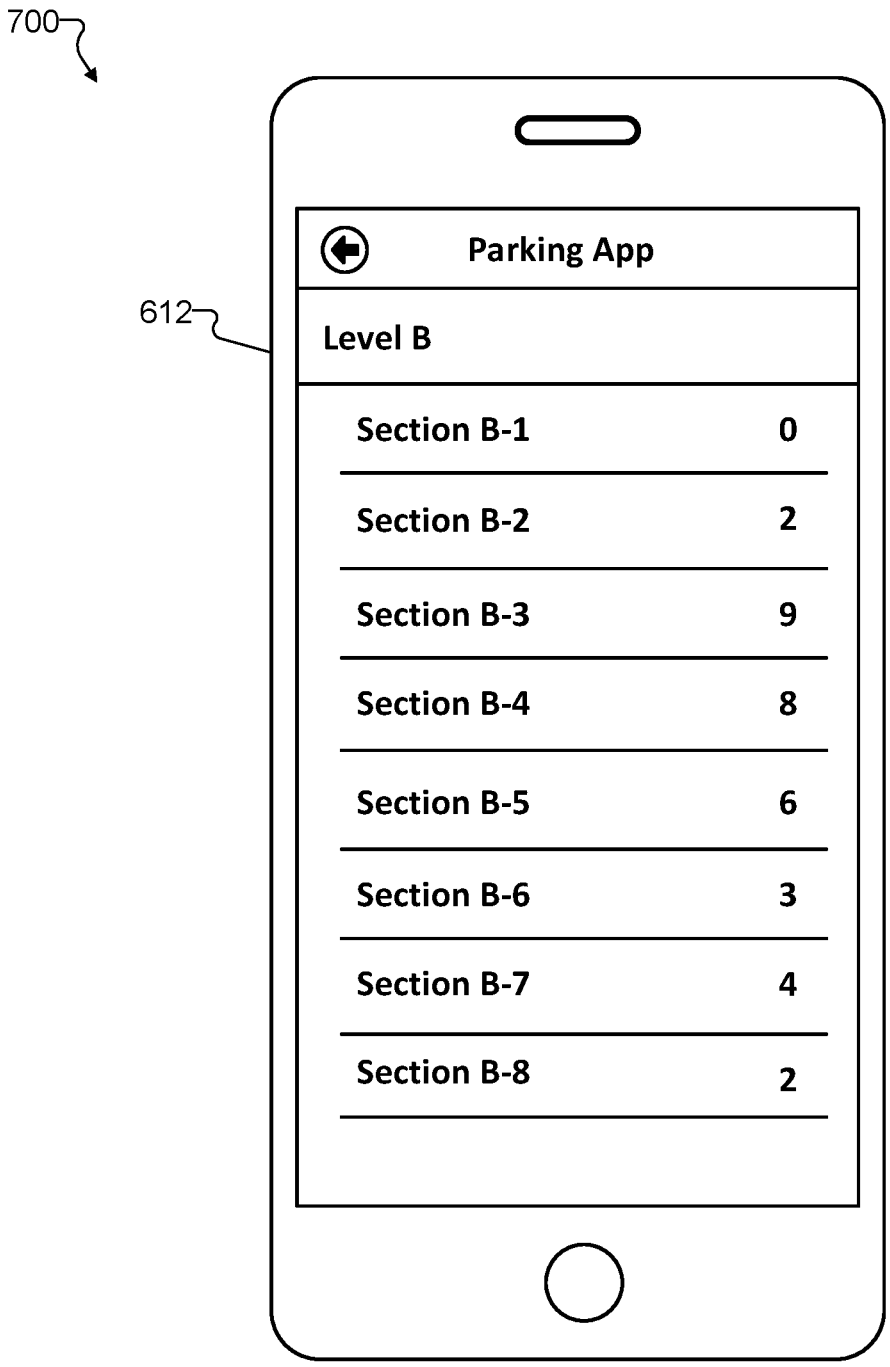
FIG. 7 illustrates an exemplary user interface implemented by an exemplary parking facilitation device to facilitate a user of the parking facilitation device in locating an available parking space according to principles described herein.

To illustrate, FIG. 7 shows an exemplary user interface 700 implemented by an exemplary parking facilitation device 612 to facilitate a respective user 614 in locating an available parking space. User interface 700 may be implemented as part of a mobile application (e.g., a downloadable "mobile app" available from a distributor such as a virtual store that provides mobile applications for download). As shown, user interface 700 may indicate how many parking spaces are currently available in each section (e.g., Section B-1 through Section B-8) of a particular level (e.g., Level B) of a parking garage. In this way, the user may conveniently determine, in real time with minimal wasted time, at which levels and/or sections he or she is mostly likely to find available parking spaces. For example, based on the information presented in FIG. 7, the user may head straight toward sections B-3 and B-4 of Level B (which still have 9 and 8 available parking spaces, respectively), while avoiding sections B-1 and B-2 (which have 0 and 2 available parking spaces, respectively).

User interface 700 may be navigable by the user (e.g., using the back button and/or other conventional navigation techniques) to further explore the availability statuses of parking spaces in other levels and sections of the parking garage and/or of other parking facilities (e.g., other parking garages, etc.). Additionally, user interface 700 may include additional features such as a reservation feature allowing a user to reserve a particular parking space before arriving at the parking area, a recommendation feature that automatically recommends a particular parking space or parking area (e.g., level, section, etc.) to the user as the user arrives at the garage, a map feature to help the user navigate to and/or within particular parking areas, and/or any other feature as may serve a particular implementation.

Returning back to FIG. 6, another type of parking facilitation device with which parking management server 606 may communicate may be represented by parking facilitation display sign 616. Unlike parking facilitation devices 612, which may be implemented by mobile devices associated with individual users 614, parking facilitation display 616 may be disposed at a site of the parking area (e.g., within or just outside a particular parking facility) and may be configured to present data to all drivers attempting to locate available parking spaces for a plurality of vehicles 618. For example, parking facilitation display sign 616 may present, to drivers within all the vehicles 618 that may use a particular parking facility, data representative of the availability statuses of the different parking spaces at which a plurality of parking space devices is disposed.

Figure 8:
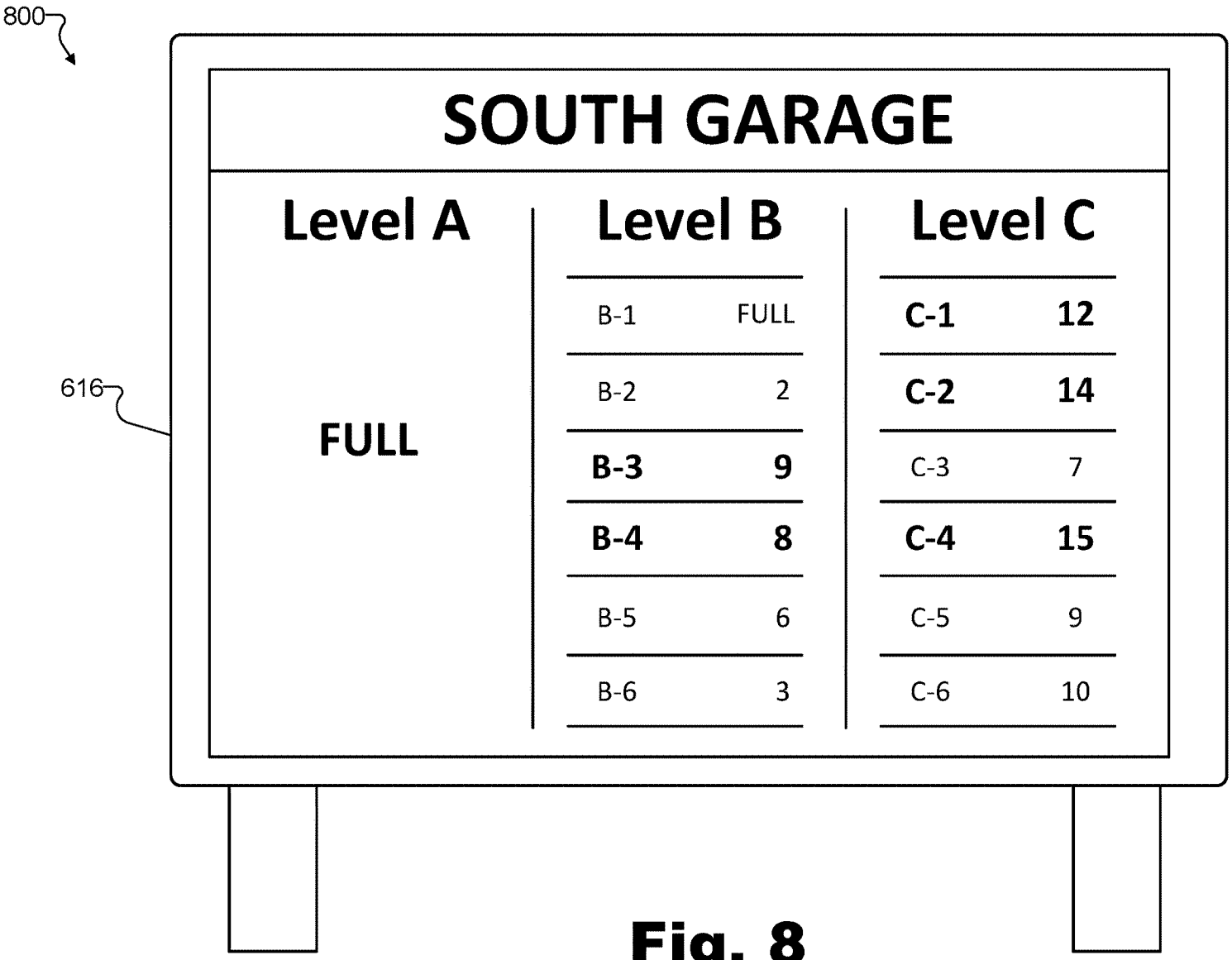
FIG. 8 illustrates another exemplary parking facilitation device for facilitating a driver in locating an available parking space according to principles described herein.

To illustrate, FIG. 8 shows an exemplary implementation of parking facilitation display sign 616 for facilitating drivers in locating available parking spaces. As shown, parking facilitation display sign 616 may display real-time and updated information 800 related to available parking spaces within different parking areas of a particular parking facility (e.g. "South Garage"). Parking facilitation display sign 616 may be located at an entrance to the "South Garage" parking facility so as to indicate, as drivers enter the garage, where the drivers are most likely to find available parking. For example, a driver presented with information 800 as shown in FIG. 8 may drive straight past Level A without trying to drive through each section to attempt to find available parking. Instead, the driver may drive directly to one of the parking areas recommended within information 800 with bold emphasis (e.g., Section B-3 or B-4 on Level B, Sections C-1, C-2, or C-4 on Level C). Information 800 may further include any other availability status information, recommendation information, or other information as may serve a particular implementation. For example, if all the parking spaces within the South Garage are unavailable, information 800 may indicate that the garage is full and recommend and/or provide directions to another parking facility that may have available parking spaces.

Returning to FIG. 6, yet another type of system to which parking management server 606 may provide the availability statuses of the parking spaces at which parking space devices 102 are disposed is represented by parking analytics system 620. Unlike parking facilitation devices 612 and parking facilitation display sign 616, parking analytics system 620 may not directly interface with drivers attempting to locate available parking spaces. Rather, parking analytics system 620 may be used by administrators of parking facilities to monitor parking space usage for purposes of determining whether more or fewer parking spaces may be needed based on the current usage of the current parking spaces that are provided. Data provided to parking analytics system 620 may be processed and stored in any suitable way and may allow parking administrators to make informed decisions leading to positive outcomes described herein such as increased productivity, increased user satisfaction, decreased parking infrastructure costs, and so forth.

Figure 9:
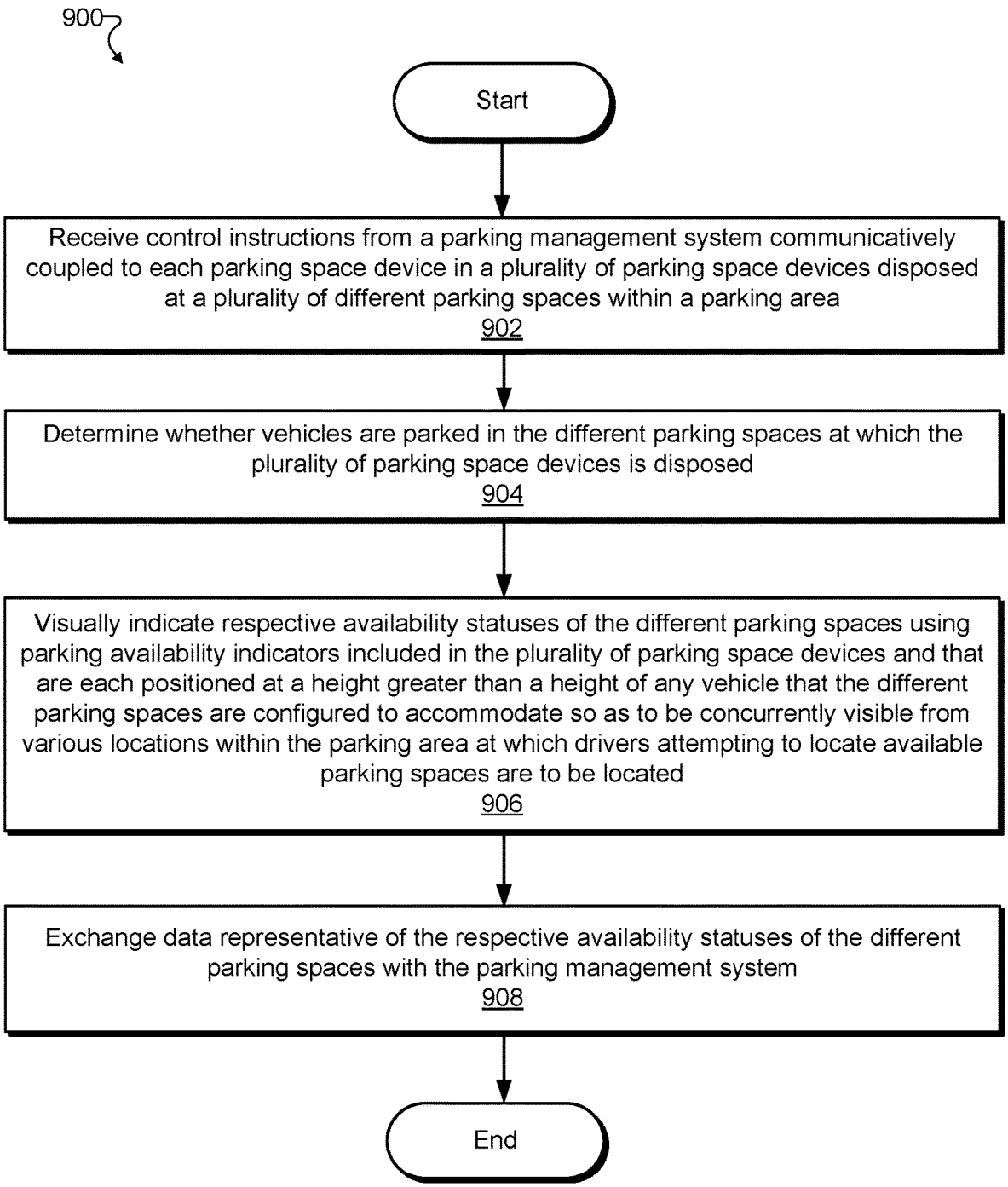
FIG. 9 illustrates an exemplary method for managing and tracking parking space availability according to principles described herein.

FIG. 9 illustrates an exemplary method 900 for managing and tracking parking space availability. While FIG. 9 illustrates exemplary operations according to one embodiment, other embodiments may omit, add to, reorder, and/or modify any of the operations shown in FIG. 9. One or more of the operations shown in FIG. 9 may be performed by a parking facilitation system such as system 100, any components included therein (e.g., one or more parking space devices 102, parking management system 110, etc.), and/or any implementation thereof.

In operation 902, a plurality of parking space devices included within a parking facilitation system and disposed at a plurality of different parking spaces within a parking area may receive control instructions. For example, the parking space devices may receive the control instructions from a parking management system communicatively coupled to each parking space device in the plurality of parking space devices. Operation 902 may be performed in any of the ways described herein.

In operation 904, respective vehicle presence detectors included within the plurality of parking space devices included within the parking facilitation system may determine whether vehicles are parked in the different parking spaces at which the plurality of parking space devices is disposed. For example, the vehicle presence detectors may determine whether the vehicles are parked in the different parking spaces in accordance with the control instructions received in operation 902. Operation 904 may be performed in any of the ways described herein.

In operation 906, respective parking availability indicators included within the plurality of parking space devices included within the parking facilitation system may visually indicate respective availability statuses of the different parking spaces. For example, the parking availability indicators may visually indicate the respective availability statuses based on the determining, in operation 904, of whether vehicles are parked in the different parking spaces. In certain examples, the parking availability indicators may be positioned at a height greater than a height of any vehicle that the different parking spaces are configured to accommodate. As such, the parking availability indicators may be concurrently visible from various locations within the parking area at which drivers attempting to locate available parking spaces are to be located. Operation 906 may be performed in any of the ways described herein.

In operation 908, the plurality of parking space devices included within the parking facilitation system may exchange, with the parking management system, data representative of the respective availability statuses of the different parking spaces. Operation 908 may be performed in any of the ways described herein.

In certain embodiments, one or more of the systems, components, and/or processes described herein may be implemented and/or performed by one or more appropriately configured computing devices. To this end, one or more of the systems and/or components described above may include or be implemented by any computer hardware and/or computer-implemented instructions (e.g., software) embodied on at least one non-transitory computer-readable medium configured to perform one or more of the processes described herein. In particular, system components may be implemented on one physical computing device or may be implemented on more than one physical computing device. Accordingly, system components may include any number of computing devices, and may employ any of a number of computer operating systems.

In certain embodiments, one or more of the processes described herein may be implemented at least in part as instructions embodied in a non-transitory computer-readable medium and executable by one or more computing devices. In general, a processor (e.g., a microprocessor) receives instructions, from a non-transitory computer-readable medium, (e.g., a memory, etc.), and executes those instructions, thereby performing one or more processes, including one or more of the processes described herein. Such instructions may be stored and/or transmitted using any of a variety of known computer-readable media.

A computer-readable medium (also referred to as a processor-readable medium) includes any non-transitory medium that participates in providing data (e.g., instructions) that may be read by a computer (e.g., by a processor of a computer). Such a medium may take many forms, including, but not limited to, non-volatile media, and/or volatile media. Non-volatile media may include, for example, optical or magnetic disks and other persistent memory. Volatile media may include, for example, dynamic random access memory ("DRAM"), which typically constitutes a main memory. Common forms of computer-readable media include, for example, a disk, hard disk, magnetic tape, any other magnetic medium, a compact disc read-only memory ("CD-ROM"), a digital video disc ("DVD"), any other optical medium, random access memory ("RAM"), programmable read-only memory ("PROM"), electrically erasable programmable read-only memory ("EPROM"), FLASH-EEPROM, any other memory chip or cartridge, or any other tangible medium from which a computer can read.

Figure 10:
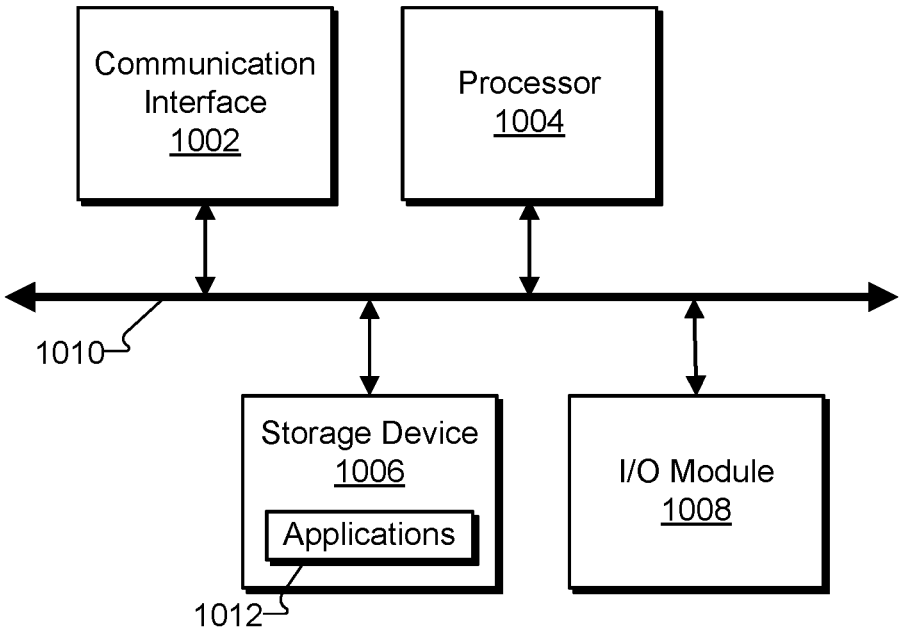
FIG. 10 illustrates an exemplary computing device according to principles described herein.

FIG. 10 illustrates an exemplary computing device 1000 that may be specifically configured to perform one or more of the processes described herein. As shown in FIG. 10, computing device 1000 may include a communication interface 1002, a processor 1004, a storage device 1006, and an input/output ("I/O") module 1008 communicatively connected via a communication infrastructure 1010. While an exemplary computing device 1000 is shown in FIG. 10, the components illustrated in FIG. 10 are not intended to be limiting. Additional or alternative components may be used in other embodiments. Components of computing device 1000 shown in FIG. 10 will now be described in additional detail.

Communication interface 1002 may be configured to communicate with one or more computing devices. Examples of communication interface 1002 include, without limitation, a wired network interface (such as a network interface card), a wireless network interface (such as a wireless network interface card), a modem, an audio/video connection, and any other suitable interface.

Processor 1004 generally represents any type or form of processing unit capable of processing data or interpreting, executing, and/or directing execution of one or more of the instructions, processes, and/or operations described herein. Processor 1004 may direct execution of operations in accordance with one or more applications 1012 or other computer-executable instructions such as may be stored in storage device 1006 or another computer-readable medium.

Storage device 1006 may include one or more data storage media, devices, or configurations and may employ any type, form, and combination of data storage media and/or device. For example, storage device 1006 may include, but is not limited to, a hard drive, network drive, flash drive, magnetic disc, optical disc, RAM, dynamic RAM, other non-volatile and/or volatile data storage units, or a combination or sub-combination thereof. Electronic data, including data described herein, may be temporarily and/or permanently stored in storage device 1006. For example, data representative of one or more executable applications 1012 configured to direct processor 1004 to perform any of the operations described herein may be stored within storage device 1006. In some examples, data may be arranged in one or more databases residing within storage device 1006.

I/O module 1008 may include one or more I/O modules configured to receive user input and provide user output. One or more I/O modules may be used to receive input for a single virtual reality experience. I/O module 1008 may include any hardware, firmware, software, or combination thereof supportive of input and output capabilities. For example, I/O module 1008 may include hardware and/or software for capturing user input, including, but not limited to, a keyboard or keypad, a touchscreen component (e.g., touchscreen display), a receiver (e.g., an RF or infrared receiver), motion sensors, and/or one or more input buttons.

I/O module 1008 may include one or more devices for presenting output to a user, including, but not limited to, a graphics engine, a display (e.g., a display screen), one or more output drivers (e.g., display drivers), one or more audio speakers, and one or more audio drivers. In certain embodiments, I/O module 1008 is configured to provide graphical data to a display for presentation to a user. The graphical data may be representative of one or more graphical user interfaces and/or any other graphical content as may serve a particular implementation.

In some examples, any of the facilities described herein may be implemented by or within one or more components of computing device 1000. For example, one or more applications 1012 residing within storage device 1006 may be configured to direct processor 1004 to perform one or more processes or functions associated with parking space device 102 or parking management system 110 of system 100. Likewise, storage facility 106 of system 100 may be implemented by a storage device associated with system 100 or a component thereof.

To the extent the aforementioned embodiments collect, store, and/or employ personal information provided by individuals, it should be understood that such information shall be used in accordance with all applicable laws concerning protection of personal information. Additionally, the collection, storage, and use of such information may be subject to consent of the individual to such activity, for example, through well known "opt-in" or "opt-out" processes as may be appropriate for the situation and type of information. Storage and use of personal information may be in an appropriately secure manner reflective of the type of information, for example, through various encryption and anonymization techniques for particularly sensitive information.

In the preceding description, various exemplary embodiments have been described with reference to the accompanying drawings. It will, however, be evident that various modifications and changes may be made thereto, and additional embodiments may be implemented, without departing from the scope of the invention as set forth in the claims that follow. For example, certain features of one embodiment described herein may be combined with or substituted for features of another embodiment described herein. The description and drawings are accordingly to be regarded in an illustrative rather than a restrictive sense.

What is claimed is:

1. A system comprising:

a plurality of parking space devices disposed at a plurality of different parking spaces within a parking area, each parking space device in the plurality of parking space devices respectively including:

a processor, a vehicle presence detector communicatively coupled to the processor and configured to determine, when directed by the processor, whether any vehicle is parked in a parking space at which the parking space device is disposed, and a parking availability indicator communicatively coupled to the processor and configured to visually indicate, when directed by the processor based on the determination of whether any vehicle is parked in the parking space, an availability status of the parking space, the parking availability indicator positioned at a height greater than a height of any vehicle that the parking space is configured to accommodate so as to be concurrently visible, with other parking availability indicators of other parking space devices in the plurality of parking space devices, from various locations within the parking area at which drivers attempting to locate available parking spaces are to be located; and a parking management system communicatively coupled to each parking space device in the plurality of parking space devices and configured to:

synchronize, with a master time maintained by the parking management system, respective local times maintained by a parking space device disposed at a parking space, a first additional parking space device, and a second additional parking space device, wherein the first additional parking space device is disposed at a first additional parking space within a radius of potential interference from the parking space device and the second additional parking space device is disposed at a second additional parking space outside the radius of potential interference from the parking space device, direct the parking space device and the second additional parking space device to determine, respectively, whether any vehicle is parked in the parking space and the second additional parking space during a first time slot of a plurality of time slots associated with the master time, direct the first additional parking space device to determine whether any vehicle is parked in the first additional parking space during a second time slot within the plurality of time slots that is distinct from, and not overlapping with, the first time slot, and exchange, with the plurality of parking space devices, data representative of the availability statuses of the different parking spaces at which the plurality of parking space devices is disposed.

2. The system of claim 1, wherein the vehicle presence detector is configured to determine whether any vehicle is parked in the parking space by:

directing a pulse toward the parking space at a first time;

detecting a reflection of the pulse from a first reflection object at a second time subsequent to the first time;

determining, based on a known travel speed of the pulse and a difference between the first and second times, a first distance from the vehicle presence detector to the first reflection object; and determining, based on a predetermined distance from the vehicle presence detector to a second reflection object from which pulses reflect when no vehicle is parked in the parking space, that no vehicle is parked in the parking space if the first distance is within a predetermined threshold of the predetermined distance, and a vehicle is parked in the parking space if the first distance is not within the predetermined threshold of the predetermined distance.

3. The system of claim 1, wherein the vehicle presence detector is configured to determine whether any vehicle is parked in the parking space by:

directing a pulse toward the parking space;

determining that no reflection from the pulse has been detected by the vehicle presence detector for a predetermined period of time after the pulse is directed toward the parking space; and determining, based on the determination that no reflection from the pulse has been detected for the predetermined period of time, that a vehicle is parked in the parking space.

4. The system of claim 1, wherein the parking management system is further configured to:

recognize, based on a machine learning algorithm, an anomalous outcome of the determination of whether any vehicle is parked in the parking space at which the parking space device is disposed; and direct the parking space device to perform a subsequent determination of whether any vehicle is parked in the parking space at which the parking space device is disposed during a third time slot within the plurality of time slots, the third time slot distinct from, and not overlapping with, the first or second time slots.

5. The system of claim 1, wherein:

the data representative of the availability statuses of the different parking spaces exchanged by the parking management system and the plurality of parking space devices includes data representative of special characteristics associated with particular parking spaces within the plurality of different parking spaces, the data representative of the special characteristics transmitted by the parking management system and received by the plurality of parking space devices; and the parking availability indicator is configured to visually indicate the availability status of the parking space based on the determination of whether any vehicle is parked in the parking space and further based on the data representative of the special characteristics transmitted by the parking management system.

6. The system of claim 1, wherein the parking availability indicator is positioned at the height greater than the height of any vehicle that the parking space is configured to accommodate by being attached above the parking space to a ceiling or structural element of a parking garage within which the parking space is contained.

7. The system of claim 1, wherein:

the parking space devices within the plurality of parking space devices are communicatively coupled to one another by way of a network;

the parking management system includes a gateway device and a parking management server communicatively coupled to the gateway device; and the gateway device is configured to facilitate communication between the plurality of parking space devices communicatively coupled to one another by way of the network and the parking management server.

8. The system of claim 1, wherein the parking management system is further configured to provide the data representative of the availability statuses of the different parking spaces to one or more parking facilitation devices communicatively coupled to the parking management system.

9. The system of claim 8, wherein the one or more parking facilitation devices include a parking facilitation display sign disposed at a site of the parking area and configured to present, to the drivers attempting to locate the available parking spaces, the data representative of the availability statuses of the different parking spaces at which the plurality of parking space devices is disposed.

10. The system of claim 8, wherein the one or more parking facilitation devices include respective mobile devices associated with the drivers attempting to locate the available parking spaces and configured to present, to the drivers, the data representative of the availability statuses of the different parking spaces at which the plurality of parking space devices is disposed.

11. A device comprising:

a processor;

a vehicle presence detector communicatively coupled to the processor and configured to determine, when directed by the processor, whether any vehicle is parked in a parking space at which the device is disposed;

a parking availability indicator communicatively coupled to the processor and configured to visually indicate, when directed by the processor based on the determination of whether any vehicle is parked in the parking space, an availability status of the parking space, the parking availability indicator positioned at a height greater than a height of any vehicle that the parking space is configured to accommodate so as to be visible from various locations within the parking area at which drivers attempting to locate available parking spaces are to be located; and a communication interface by way of which the processor is communicatively coupled with a parking management system configured to:

synchronize, with a master time maintained by the parking management system, respective local times maintained by the device, a first additional device, and a second additional device, wherein the first additional device is disposed at a first additional parking space within a radius of potential interference from the device and the second additional device is disposed at a second additional parking space outside the radius of potential interference from the device, direct the device and the second additional device to determine, respectively, whether any vehicle is parked in the parking space and the second additional parking space during a first time slot of a plurality of time slots associated with the master time, direct the first additional parking space device to determine whether any vehicle is parked in the first additional parking space during a second time slot within the plurality of time slots that is distinct from, and not overlapping with, the first time slot, and exchange, with the device and the first and second additional devices, data representative of the availability status of the parking space and the first and second additional parking spaces.

12. A method comprising:

receiving, by a plurality of parking space devices disposed at a plurality of different parking spaces within a parking area, control instructions from a parking management system communicatively coupled to each parking space device in the plurality of parking space devices and configured to:

synchronize, with a master time maintained by the parking management system, respective local times maintained by a parking space device disposed at a parking space, a first additional parking space device, and a second additional parking space device, wherein the first additional parking space device is disposed at a first additional parking space within a radius of potential interference from the parking space device and the second additional parking space device is disposed at a second additional parking space outside the radius of potential interference from the parking space device, direct the parking space device and the second additional parking space device to determine, respectively, whether any vehicle is parked in the parking space and the second additional parking space during a first time slot of a plurality of time slots associated with the master time, direct the first additional parking space device to determine whether any vehicle is parked in the first additional parking space during a second time slot within the plurality of time slots that is distinct from, and not overlapping with, the first time slot;

determining, by respective vehicle presence detectors included within the plurality of parking space devices and in accordance with the control instructions, whether vehicles are parked in the different parking spaces at which the plurality of parking space devices is disposed;

visually indicating, by respective parking availability indicators included within the plurality of parking space devices based on the determining of whether vehicles are parked in the different parking spaces, respective availability statuses of the different parking spaces, the parking availability indicators positioned at a height greater than a height of any vehicle that the different parking spaces are configured to accommodate so as to be concurrently visible from various locations within the parking area at which drivers attempting to locate available parking spaces are to be located; and exchanging, by the plurality of parking space devices with the parking management system, data representative of the respective availability statuses of the different parking spaces.

13. The method of claim 12, wherein the determining, by each vehicle presence detector included within each parking space device included within the plurality of parking space devices, whether any vehicle is parked in a respective parking space at which the parking space device is disposed includes:

directing a pulse toward the respective parking space at a first time;

detecting a reflection of the pulse from a first reflection object at a second time subsequent to the first time;

determining, based on a known travel speed of the pulse and a difference between the first and second times, a first distance from the vehicle presence detector to the first reflection object; and determining, based on a predetermined distance from the vehicle presence detector to a second reflection object from which pulses reflect when no vehicle is parked in the respective parking space, that no vehicle is parked in the respective parking space if the first distance is within a predetermined threshold of the predetermined distance, and a vehicle is parked in the respective parking space if the first distance is not within the predetermined threshold of the predetermined distance.

14. The method of claim 12, wherein the determining, by each vehicle presence detector included within each parking space device included within the plurality of parking space devices, whether any vehicle is parked in a respective parking space at which the parking space device is disposed includes:

directing a pulse toward the respective parking space;

determining that no reflection from the pulse has been detected by the vehicle presence detector for a predetermined period of time after the pulse is directed toward the respective parking space; and determining, based on the determination that no reflection from the pulse has been detected for the predetermined period of time, that a vehicle is parked in the respective parking space.

15. The method of claim 12, wherein the respective parking availability indicators are positioned at the height greater than the height of any vehicle that the different parking spaces are configured to accommodate by being attached above the different parking spaces to a ceiling or structural element of a parking garage within which the different parking spaces are contained.

16. The method of claim 12, wherein the exchanging includes providing, by the parking management system, the data representative of the respective availability statuses of the different parking spaces to one or more parking facilitation devices communicatively coupled to the parking management system, wherein the one or more parking facilitation devices include at least one of:

a parking facilitation display sign disposed at a site of the parking area and configured to present, to the drivers attempting to locate the available parking spaces, the data representative of the availability statuses of the different parking spaces at which the plurality of parking space devices is disposed; and respective mobile devices associated with the drivers attempting to locate the available parking spaces and configured to present, to the drivers, the data representative of the availability statuses of the different parking spaces at which the plurality of parking space devices is disposed.

17. The method of claim 12, embodied as computer-executable instructions on at least one non-transitory computer-readable medium.

18. The method of claim 12, wherein the parking management system is further configured to:

recognize, based on a machine learning algorithm, an anomalous outcome of the determination of whether any vehicle is parked in the parking space at which the parking space device is disposed; and direct the parking space device to perform a subsequent determination of whether any vehicle is parked in the parking space at which the parking space device is disposed during a third time slot within the plurality of time slots, the third time slot distinct from, and not overlapping with, the first or second time slots.

19. The method of claim 12, wherein:

the data representative of the availability statuses of the different parking spaces exchanged by the parking management system and the plurality of parking space devices includes data representative of special characteristics associated with particular parking spaces within the plurality of different parking spaces, the data representative of the special characteristics transmitted by the parking management system and received by the plurality of parking space devices; and the visually indicating of the respective availability statuses of the different parking spaces is based on the determining of whether vehicles are parked in the different parking spaces and further based on the data representative of the special characteristics transmitted by the parking management system.

20. The method of claim 12, wherein:

the parking space devices within the plurality of parking space devices are communicatively coupled to one another by way of a network;

the parking management system includes a gateway device and a parking management server communicatively coupled to the gateway device; and the receiving of the control instructions from the parking management system is performed by way of the network and facilitated by the gateway device of the parking management system.

* * * * *